US009233267B2

(12) United States Patent
Wilkins

(10) Patent No.: US 9,233,267 B2
(45) Date of Patent: Jan. 12, 2016

(54) ADJUSTABLE REBOUND DEVICE AND EXERCISE MACHINE INCLUDING ADJUSTABLE REBOUND DEVICE

(71) Applicant: Larry C Wilkins, Ft. Lauderdale, FL (US)

(72) Inventor: Larry C Wilkins, Ft. Lauderdale, FL (US)

(73) Assignee: WILKINS IP, LLC, New Albany, IN (US)

( * ) Notice: Subject to any disclaimer, the term of this patent is extended or adjusted under 35 U.S.C. 154(b) by 203 days.

(21) Appl. No.: 14/132,278

(22) Filed: Dec. 18, 2013

(65) Prior Publication Data

US 2014/0179492 A1 Jun. 26, 2014

Related U.S. Application Data

(60) Provisional application No. 61/740,081, filed on Dec. 20, 2012.

(51) Int. Cl.
*A63B 5/00* (2006.01)
*A63B 5/11* (2006.01)
(Continued)

(52) U.S. Cl.
CPC ..... *A63B 5/08* (2013.01); *A63B 71/0619* (2013.01); *A63B 2071/025* (2013.01); *A63B 2220/50* (2013.01); *A63B 2220/64* (2013.01); *A63B 2225/09* (2013.01); *A63B 2225/093* (2013.01); *A63B 2230/06* (2013.01); *A63B 2230/75* (2013.01)

(58) Field of Classification Search
CPC ..... A63B 5/00; A63B 5/08; A63B 5/11; A63B 2005/085; A63B 6/00; A63B 21/0414; A63B 21/0421; A63B 21/0435; A63B 21/045; A63B 22/0046; A63B 2022/0207; A63B 2022/0214; A63B 2022/0221; A63B 2022/0228; A63B 71/0619; A63B 2071/025; A63B 2220/50; A63B 2220/64; A63B 2225/09; A63B 2225/093; A63B 2230/06; A63B 2230/75
USPC ..... 482/26–32
See application file for complete search history.

(56) References Cited

U.S. PATENT DOCUMENTS 5,387,166 A * 2/1995 Gvoich ..... 482/52
5,562,575 A * 10/1996 Gvoich ..... 482/52
(Continued)

FOREIGN PATENT DOCUMENTS

GB 888616 A * 1/1962

*Primary Examiner* — Oren Ginsberg
*Assistant Examiner* — Joshua Lee
(74) *Attorney, Agent, or Firm* — Finnegan, Henderson, Farabow, Garrett & Dunner, L.L.P.

(57) ABSTRACT

An adjustable rebound device may include a support platform and a warping assembly to adjust a rebound resistance of the support platform. The warping assembly may include a plurality of mounting assemblies coupled to the support platform and a rebound adjustment assembly coupled to at least one of the mounting assemblies. The rebound adjustment assembly may be configured to actuate a mounting assembly such that the support platform is warped and a rebound resistance is adjusted. A method for adjusting a rebound resistance of a platform assembly is also described. An exercise machine may include a machine base assembly, a support platform, and a warping assembly. The warping assembly may include a plurality of mounting assemblies and a rebound adjustment assembly, such that the rebound adjustment assembly is configured to actuate a mounting assembly such that the support platform is warped and a rebound resistance is adjusted.

40 Claims, 17 Drawing Sheets

(51) Int. Cl.

| | |
|---|---|
| ***A63B 5/08*** | (2006.01) |
| ***A63B 71/06*** | (2006.01) |
| *A63B 71/02* | (2006.01) |

(56) References Cited

U.S. PATENT DOCUMENTS 5,565,003 A * 10/1996 Gerstung et al. ..... 482/26
6,132,338 A * 10/2000 Shifferaw ..... 482/30
7,041,033 B2 * 5/2006 Tom ..... 482/10
2004/0259689 A1 * 12/2004 Wilkins et al. ..... 482/8
2007/0032353 A1 * 2/2007 Wilkins et al. ..... 482/54
2008/0119337 A1 * 5/2008 Wilkins et al. ..... 482/130
2012/0270704 A1 * 10/2012 Wang ..... 482/54

* cited by examiner

SECTION A-A

SECTION B-B

DETAIL A

SECTION B-B
WARPED

DETAIL A
WARPED

SECTION C-C

DETAIL B

SECTION C-C
WARPED

DETAIL B
WARPED

DETAIL C

ADJUSTABLE REBOUND DEVICE AND EXERCISE MACHINE INCLUDING ADJUSTABLE REBOUND DEVICE

CROSS-REFERENCE TO RELATED APPLICATION

This application claims the benefit of priority under 35 U.S.C. §119(e) of U.S. Provisional Application No. 61/740,081, filed Dec. 20, 2012, the disclosure of which is incorporated herein by reference.

FIELD OF THE DISCLOSURE

The present disclosure relates to an adjustable rebound device and a method for adjusting the rebound of a support platform. In addition, the present disclosure relates to an exercise machine including an adjustable rebound device.

BACKGROUND

Exercise techniques may include either upper body or lower body workouts. Some forms of exercise include jogging in place, jumping rope, or plyometrics. Plyometrics includes repeated stretching and contracting of muscles, such as by jumping or rebounding. Some studies suggest that plyometric exercises may help increase bone density, preventing osteoporosis.

One possible drawback of many exercise techniques, such as plyometrics, jumping rope, or jogging in place, is that the exercise is performed consistently on the same surface. For example, a person may jump rope on an asphalt or concrete pad, or a plyometric exerciser may perform a workout on grass or a synthetic surface, such as tartan. On such surfaces, there is typically no ability to alter the characteristics of the surface for the particular exerciser.

Another possible drawback is that certain people may not be able to perform a sustained workout due to the characteristics of the particular surface. For example, when a surface has less rebound, such as concrete, elderly or injured individuals exercising on the surface may tire more quickly than when exercising on a surface that has more rebound, such as a small trampoline. Similarly, because many exercises are often performed on ground or flooring surfaces, such as grass, concrete, hardwood, or tartan, even trained athletes may be prevented from adjusting their workout to suit their particular needs. As a result, it is often difficult for an exerciser to adjust their workout, except by changing the number of repetitions or the duration of performance of the exercise. While the exerciser may be able to perform the exercises faster or slower, or by jumping higher or lower, the exerciser cannot adjust the amount of resistance provided by the surface during a particular workout. Thus, there is no way for a person to adjust the rebound of a given surface to make it more or less rebound resistant.

Similarly, exercises such as plyometrics or jumping rope are often performed outdoors or in an open space. Thus, it may be difficult for a person to maintain a regular cadence during a workout or record the number of repetitions performed. Because the surface is often a ground or flooring surface, it is not possible for a user to calculate the volume of the workout or to verify whether their actual cadence matches a desired cadence when performing a jumping exercise.

Thus, it may be desirable to provide a device with an adjustable rebound. Further, it may be desirable to provide a method for adjusting the rebound of a support platform. It may also be desirable to provide an exercise machine having an adjustable rebound device.

SUMMARY

In the following description, certain aspects and embodiments will become evident. It is contemplated that the aspects and embodiments, in their broadest sense, could be practiced without having one or more features of these aspects and embodiments. It is also contemplated that these aspects and embodiments are merely exemplary.

One aspect of the disclosure relates to an adjustable rebound device. The adjustable rebound device includes a support platform and a warping assembly. The warping assembly is configured to adjust the rebound resistance of the support platform. The warping assembly includes a plurality of mounting assemblies coupled to the support platform and a rebound adjustment assembly. The rebound adjustment assembly is coupled to at least one of the mounting assemblies and is configured to actuate the mounting assembly. Actuation of the mounting assembly warps the support platform and adjusts the rebound resistance of the support platform.

According to another aspect, the adjustable rebound device includes a shaft coupled to a mounting assembly such that movement of the shaft causes the support platform to warp. The adjustable rebound device further includes a receiver coupled to the support platform and a retainer coupled to the shaft. In another aspect, the shaft includes a threaded portion, and the retainer includes a threaded portion. The threaded portion of the shaft is threadedly engaged with the threaded portion of the retainer, such that rotation of the shaft causes movement of the receiver. According to another aspect, the retainer includes a rod portion, and the receiver includes a recess receiving the rod portion in which the rod portion rotates upon rotation of the shaft.

According to still a further aspect, the support platform is an elastically deformable material. The elastically deformable material includes, for example, polycarbonate.

According to yet another aspect, warping the support platform includes crowning the support platform, and crowning the support platform increases the rebound resistance of the support platform.

According still another aspect, the adjustable rebound device includes a motor coupled to the warping assembly. The motor is configured such that operation of the motor causes actuation of the mounting assembly, thereby warping the support platform.

According to still another aspect, the adjustable resistance device includes a basal mount and a linkage arm. The linkage arm is pivotally coupled to the basal mount and the at least one mounting assembly. Upon actuation of the mounting assembly, the linkage arm pivots relative to the mounting assembly and the basal mount.

Another aspect of the disclosure relates to a method of adjusting the rebound resistance of a support platform. The method includes coupling a support platform to a warping assembly. The warping assembly is configured to adjust the rebound resistance of the support platform. The warping assembly includes a plurality of mounting assemblies that are coupled to the support platform. The warping assembly further includes a rebound adjustment assembly coupled to at least one of the mounting assemblies. The method also includes actuating a mounting assembly via the rebound adjustment assembly. Actuation of the mounting assembly causes the support platform to warp, and warping of the support platform adjusts the rebound resistance of the support platform.

According to another aspect, the method includes moving a shaft coupled to the mounting assembly such that movement of the shaft causes the support platform to warp. Moving the shaft causes movement of a receiver. The receiver is part of the mounting assembly, and the receiver may operate in conjunction with a retainer. The retainer is coupled to the shaft such that movement of the shaft moves the retainer, thereby causing the support platform to warp. In another aspect, the shaft includes a threaded portion, and the retainer includes a threaded portion. The threaded portion of the shaft engages with the threaded portion of the retainer. Moving the shaft includes rotating the shaft, such that rotation of the shaft causes movement of the receiver. According to another aspect, rotating the shaft causes rotation of a rod portion of the retainer relative to a recess portion of the receiver. The recess portion is configured to receive the rod portion.

According to yet another aspect, warping the support platform includes crowning the support platform, and crowning the support platform increases the rebound resistance of the support platform.

According to still another aspect, the method includes operating a motor coupled to the warping assembly. The motor is configured to actuate the mounting assembly, thereby warping the support platform.

According to still another aspect, the method includes actuating a mounting assembly, thereby causing pivoting of a linkage arm. The linkage arm is pivotally coupled to a basal mount and the mounting assembly. Upon actuation of the mounting assembly, the linkage arm pivots relative to the mounting assembly and the basal mount.

Another aspect of the disclosure relates to an exercise machine having an adjustable rebound device. The exercise machine includes a machine base assembly having a first frame portion and a second frame portion. The exercise machine also includes a support platform and a warping assembly. The warping assembly is configured to adjust the rebound resistance of the support platform. The warping assembly includes a plurality of mounting assemblies coupled to the support platform and a rebound adjustment assembly. The rebound adjustment assembly is coupled to at least one of the mounting assemblies and is configured to actuate the mounting assembly. Actuation of the mounting assembly warps the support platform and adjusts the rebound resistance of the support platform.

According to another aspect, the exercise machine includes a shaft coupled to a mounting assembly such that movement of the shaft causes the support platform to warp. The exercise machine further includes a receiver coupled to the support platform and a retainer coupled to the shaft. In another aspect, the shaft includes a threaded portion, and the retainer includes a threaded portion. The threaded portion of the shaft is threadedly engaged with the threaded portion of the retainer, such that rotation of the shaft causes movement of the receiver. According to another aspect, the retainer includes a rod portion, and the receiver includes a recess for receiving the rod portion, such that the rod portion is configured to rotate relative to the recess upon rotation of the shaft.

According to still a further aspect, the support platform includes an elastically deformable material, and the elastically deformable material includes, for example, polycarbonate.

According to yet another aspect, warping the support platform includes crowning the support platform. Crowning the support platform increases the rebound resistance of the support platform.

According to still another aspect, the exercise machine includes a user interface. The user interface is configured to facilitate control of the machine and feedback to the user. The user interface includes a control unit. The control unit is configured to facilitate actuation of the warping assembly.

In another aspect, the control unit is configured to provide an aural or visual cue to the user. The aural or visual cue indicates that the user should jump on the machine.

According to still another aspect, the exercise machine includes first, second, and third light sources associated with the machine base assembly. The light sources provide a visual cue for jumping. The exercise machine also includes a controller for controlling illumination of the first, second, and third light sources. The first, second, and third light sources are aligned with one another, and the controller sequentially illuminates each of the first, second, and third light sources.

According to still another aspect, the exercise machine may include a sensor configured to provide signal indicative of mechanical strain of the support platform. The sensor may measure a number of compression cycles associated with the support platform. The sensor is coupled to the control unit, and the control unit is configured to determine a compression cycle rate associated with the support platform based on the signals from the sensor. The control unit may also be configured to output an indication of the compression cycle rate on a display unit. The control unit is configured to compare the compression cycle rate with a predetermined rate, and if the compression cycle rate differs from the predetermined rate by more than a predetermined amount, to output a fault signal. The control unit may also be configured to compare a timing period of the number of compression cycles with a timer and, If the timing period of the number of compression cycles differs from the timer by more than a predetermined amount, to output a fault signal. The control unit is configured to output a visual indicator or an aural indicator based on the fault signal. The visual indicator is displayed on the display unit.

According still another aspect, the exercise machine includes a motor coupled to the warping assembly, wherein operation of the motor is configured to cause actuation of the mounting assembly such that the support platform is warped.

According to yet another aspect, the exercise machine at least one basal mount and a linkage arm pivotally coupled to the basal mount and the mounting assembly. Upon actuation of the mounting assembly by the rebound adjustment assembly, the linkage arm pivots relative to the basal mount and the mounting assembly, such that the support platform is warped.

It is to be understood that both the foregoing general description and the following detailed description are exemplary and explanatory only and are not restrictive of the invention. The accompanying drawings, which are incorporated in and constitute a part of this specification, illustrate several exemplary embodiments and together with the description, serve to outline principles of the exemplary embodiments.

DESCRIPTION OF EXEMPLARY EMBODIMENTS

Reference will now be made in detail to exemplary embodiments illustrated in the accompanying drawings. Wherever possible, the same reference numbers will be used throughout the drawings to refer to the same or like parts.

Figure 1:
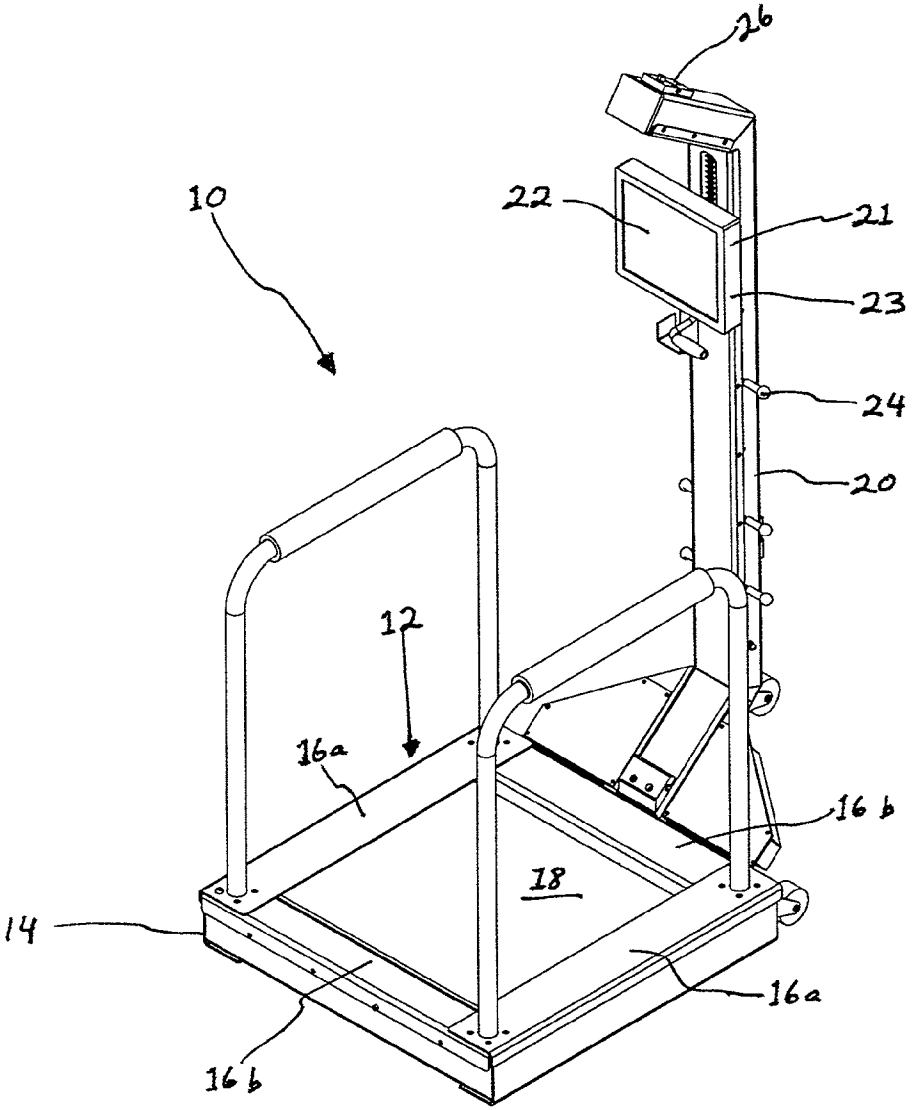
FIG. 1 is a perspective view of an exemplary embodiment of an exercise machine having an exemplary adjustable rebound platform.
Figure 2:
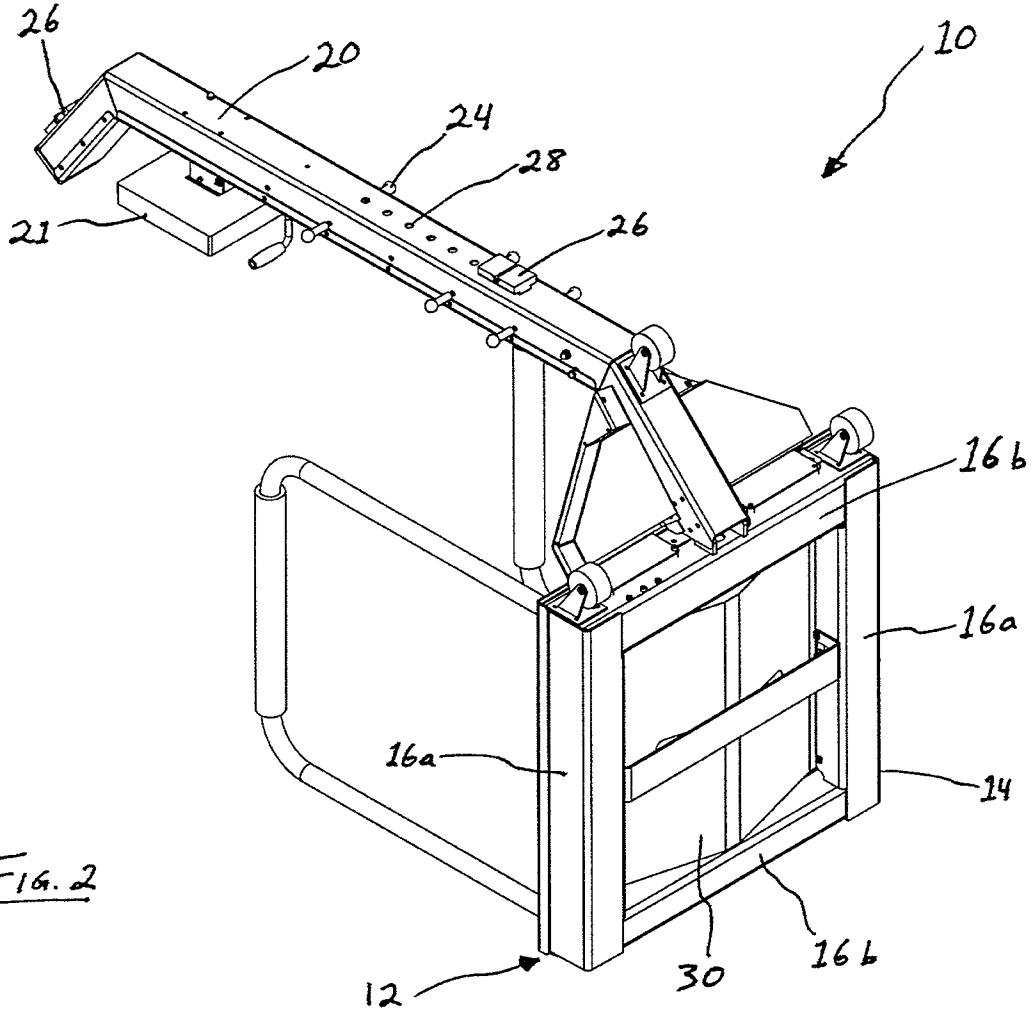
FIG. 2 is a perspective view of the exemplary embodiment shown in FIG. 1 as viewed from below.

FIGS. 1 and 2 show an exemplary embodiment of an exercise machine 10 having an adjustable rebound platform 12. Exemplary exercise machine 10 includes several components which are not limiting of this embodiment, nor does the inclusion of one element here preclude the use of alternative components. For example, exemplary exercise machine 10 includes an adjustable rebound platform 12 having a machine base assembly 14. A user may perform exercises on exemplary exercise machine 10 by jumping on an exemplary support platform 18 of adjustable rebound platform 12. The user may to alter a rebound resistance of support platform 18 to alter the characteristics of adjustable rebound platform 12. In this way, the user may alter the characteristics of the surface on which the user performs a jumping exercise or other exercises.

Exemplary machine base assembly 14 includes exemplary frame portions 16*a* and 16*b*. Frame portions 16*a* are positioned on opposing sides of machine base assembly 14 relative to a user standing on support platform 18 and facing a column 20. Frame portions 16*b* are positioned at the front and rear of machine base assembly 14 relative to a user standing on support platform 18 and facing column 20. However, alternative embodiments may include only frame portions 16*a* or only frame portions 16*b*. Exemplary support platform 18 is part of adjustable rebound platform 12.

Exemplary exercise machine 10 also includes a column 20, which includes a user interface 21. According to some embodiments, user interface 21 includes a visual display unit 22 and/or control unit 23. Column 20 may also include grips or handles 24 and/or mounting plates 26. Exemplary grips or handles 24 may be used as handles by a user of exercise machine 10. Grips or handles 24 or mounting plates 26 may also be used to mount additional equipment, such as elastic resistance bands. In some embodiments, grips or handles 24 or mounting plates 26 may be either fixed or adjustable. For example, grips or handles 24 and mounting plates 26 may be adjusted by placing them in one of exemplary mounting holes 28, as shown in FIG. 2. Exemplary exercise machine 10 may also include a reflector 30, as shown in FIG. 2. Exemplary reflector 30 will be described in greater detail below.

Figure 3:
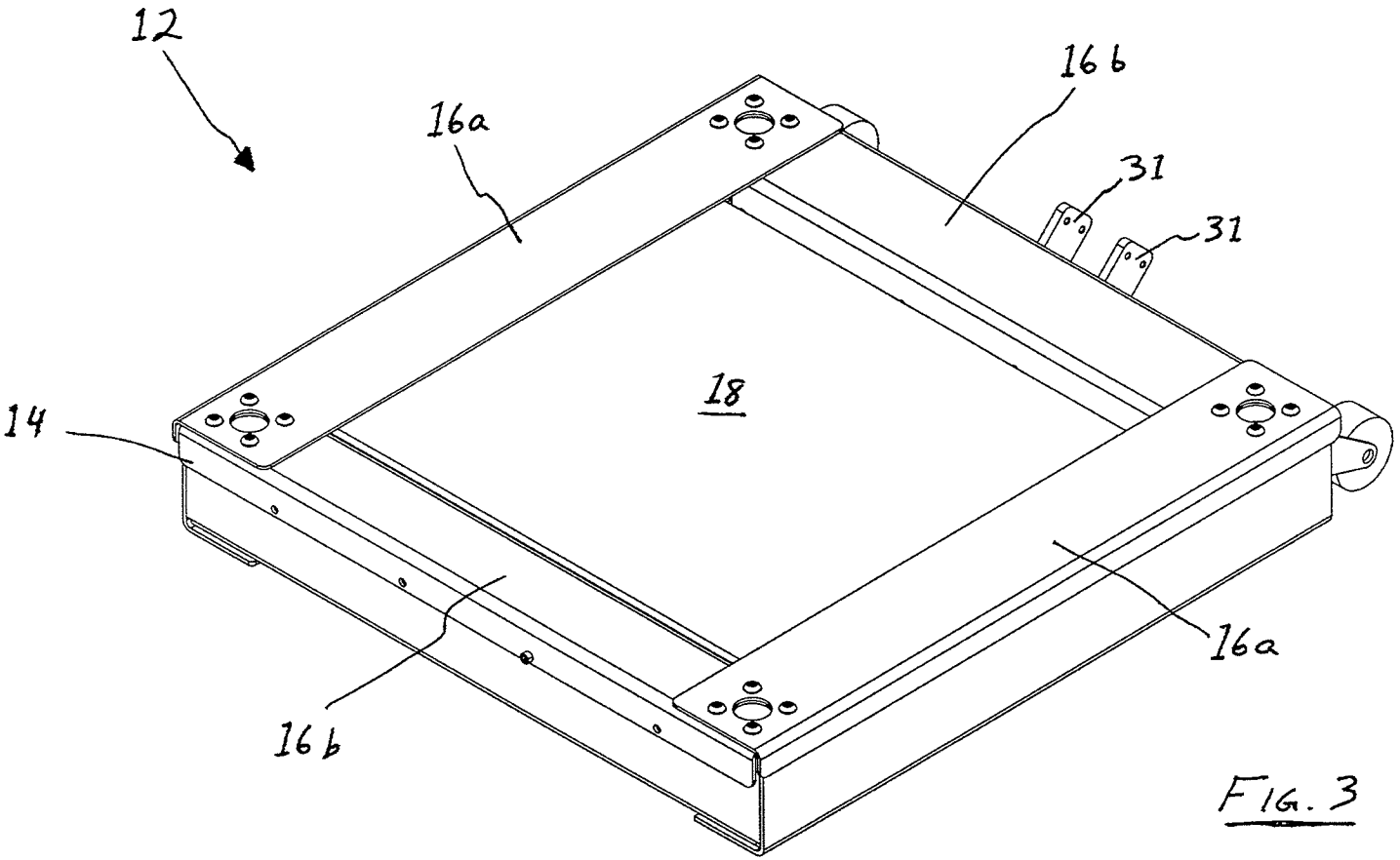
FIG. 3 is a perspective view of an exemplary embodiment of an adjustable rebound device.

FIG. 3 shows an exemplary embodiment of adjustable rebound platform 12, including machine base assembly 14. Exemplary frame portions 16*a* and 16*b* are shown on each side of support platform 18. Although FIG. 3 identifies frame portions 16*a* and 16*b*, alternative embodiments may include only frame portions 16*a* or frame portions 16*b*. In the exemplary embodiment shown in FIG. 3, support platform 18 is positioned between frame portions 16*a* and 16*b*. Machine base assembly 14 also includes exemplary column mounts 31 for coupling column 20 to adjustable rebound platform 12.

Figure 4:
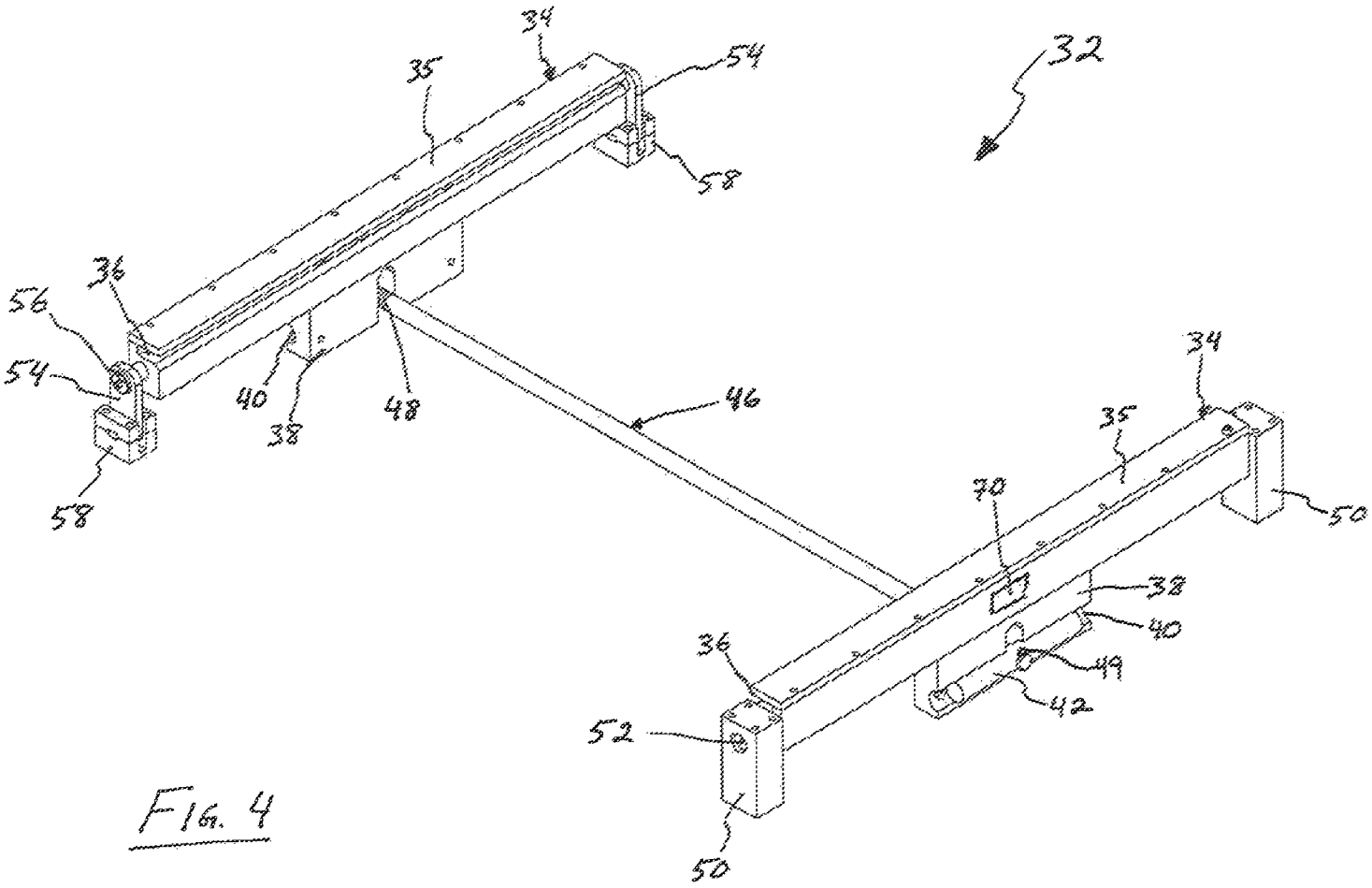
FIG. 4 is a perspective view of an exemplary embodiment of a warping assembly.

FIG. 4 shows an exemplary warping assembly 32, which may be part of adjustable rebound platform 12. Exemplary warping assembly 32 includes a plurality of mounting assemblies 34. Each mounting assembly 34 is coupled to support platform 18 (see, e.g., FIG. 8).

According to some embodiments, each mounting assembly 34 includes a fixing element 35 coupled to support platform 18. For example, fixing elements 35 include a slot 36 receiving an edge of support platform 18, thereby coupling support platform 18 to mounting assemblies 34. According to some embodiments, support platform 18 may be clamped or fixedly attached to respective slots 36 of fixing elements 35.

Mounting assemblies 34 may include one or more components that may be actuated as part of exemplary warping assembly 32. According to some embodiments, each mounting assembly 34 includes a receiver 38, which in some embodiments, may also include a recess 40. According to some embodiments, a retainer 42 may be received by recess 40. According to the exemplary embodiment shown in FIG. 4, recess 40 is a curved recess, such as a half-round slot, for receiving exemplary retainer 42. In other embodiments, recess 40 may be non-curved, or may include at least one through-hole for receiving a retainer 42. As depicted in FIG. 4, exemplary retainer 42 may include a rod portion. In other embodiments, retainer 42 may be non-rod shaped and may include a pivot-device, such that actuation of the mounting assembly 34 causes the pivot-device of retainer 42 to pivot about retainer 42. Receiver 38 and recess 40 may be substituted, according to some embodiments, with an aperture for receiving retainer 42. According to some embodiments, the aperture may include an eye-screw coupled to mounting assembly 34, where retainer 42 is received within the eye of the eye-screw.

As shown in FIG. 4, a shaft 46 may be connected to opposing mounting assemblies 34. In some embodiments, shaft 46 may be connected to opposing retainers 42. As shown, exemplary shaft 46 includes threaded portions 48 threadedly engaged to threaded portions 49 of retainers 42 (see, e.g., FIG. 18). In the exemplary embodiment shown, recesses 40 prevent rotation of retainers 42 as shaft 46 rotates about cylindrical axis of shaft 46. Because retainers 42 are prevented from rotating about cylindrical axis of shaft 46, the rotation of shaft 46 in a first direction pulls retainers 42 inwardly toward recesses 40 as the threaded portions 48 of shaft 46 engage with the threaded portions of retainers 42. Rotation of shaft 46 in the opposite direction pushes retainers 42 away from recesses 40. According to this exemplary operation, rotation of shaft 46 causes actuation of mounting assemblies 34, thereby causing warping of support platform 18 (see, e.g., FIGS. 8 and 10).

Exemplary fixing elements 35 pivot during actuation of mounting assemblies 34. For example, one of mounting assemblies 34 includes opposing mounting blocks 50 coupled to machine base assembly 14 (see FIG. 12). Corresponding fixing element 35 is coupled to mounting blocks 50 via pivot members 52 such that fixing element 35 pivots when mounting assemblies 34 are actuated, thereby warping support platform 18.

In the exemplary embodiment shown, an opposing mounting assembly 34 also pivots during actuation of mounting assemblies 34. For example opposing mounting assembly 34 includes an opposing pair of basal mounts 58 between which a corresponding fixing element 35 extends. Fixing element 35 is coupled to basal mounts 58 by a pair of linkage arms 54. Linkage arms 54 are pivotally coupled to basal mounts 58 and fixing element 35 via pivot members 56 and 64, such that fixing element 35 pivots with respect to linkage arms 54, and linkage arms 54 pivot with respect to basal mounts 58.

This exemplary coupling between fixing elements 35 and respective mounting blocks 50 and basal mounts 58 permits support platform 18 to crown upon activation of warping assembly 32, such that the edges of support platform 18 received in slots 36 do not slide (or do not substantially slide) with respect to slots 36. This may prevent or reduce the likelihood of damage to the edges of support platform 18 resulting from repeated adjustment of warping assembly 32 and/or compression of support platform 18, such as when a user performs a jumping exercise.

It is contemplated that warping assembly 32 may include alternative configurations in which mounting blocks 50 are substituted for linkage arms 54, or vice versa. For example, mounting blocks 50 may be coupled to mounting assemblies 34 on both sides of warping assembly 32. Alternatively, linkage arms 54 may be coupled to mounting assemblies 34 on both sides of warping assembly 32.

Figure 5:
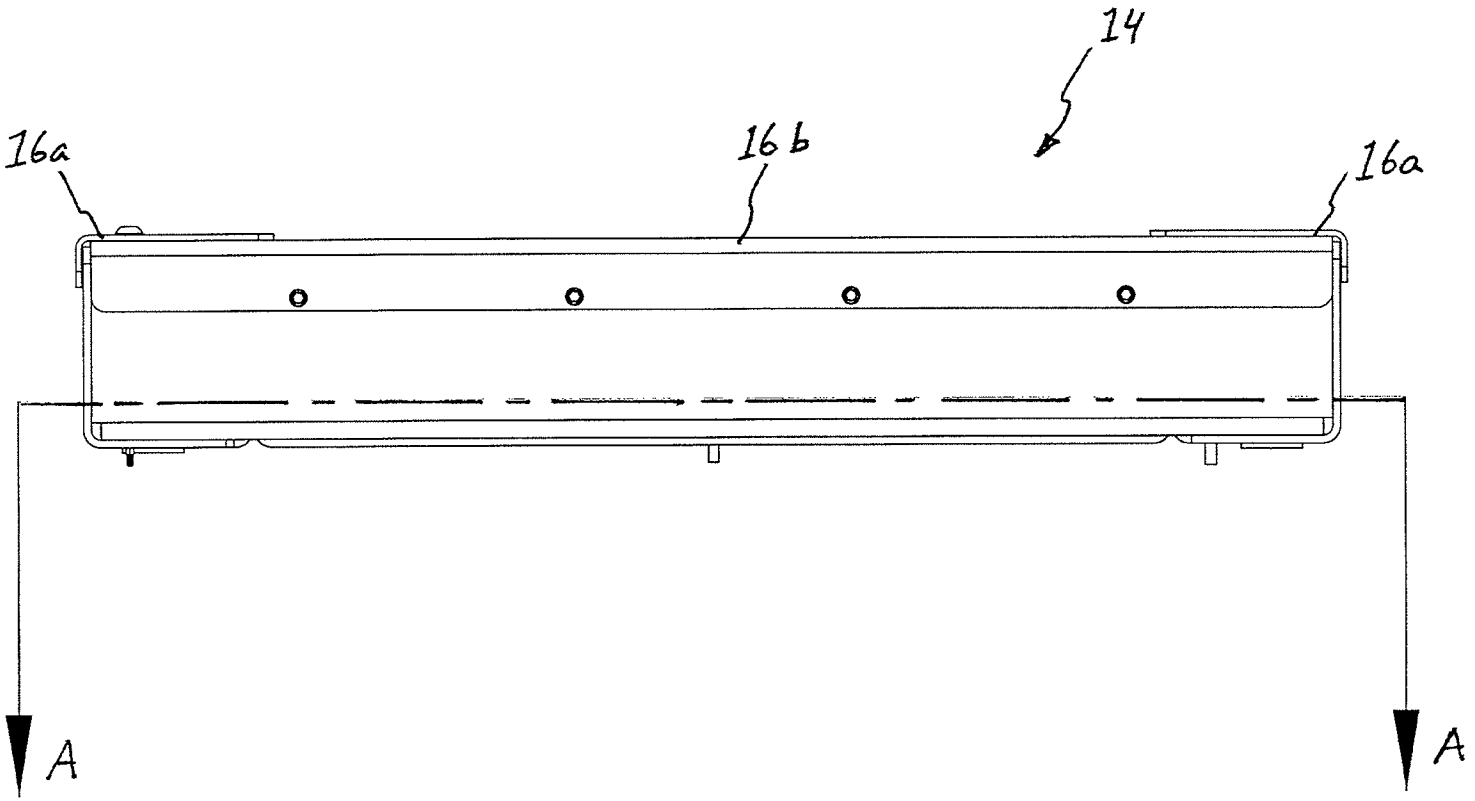
FIG. 5 is a front view of the exemplary adjustable rebound device shown in FIG. 3.
Figure 6:
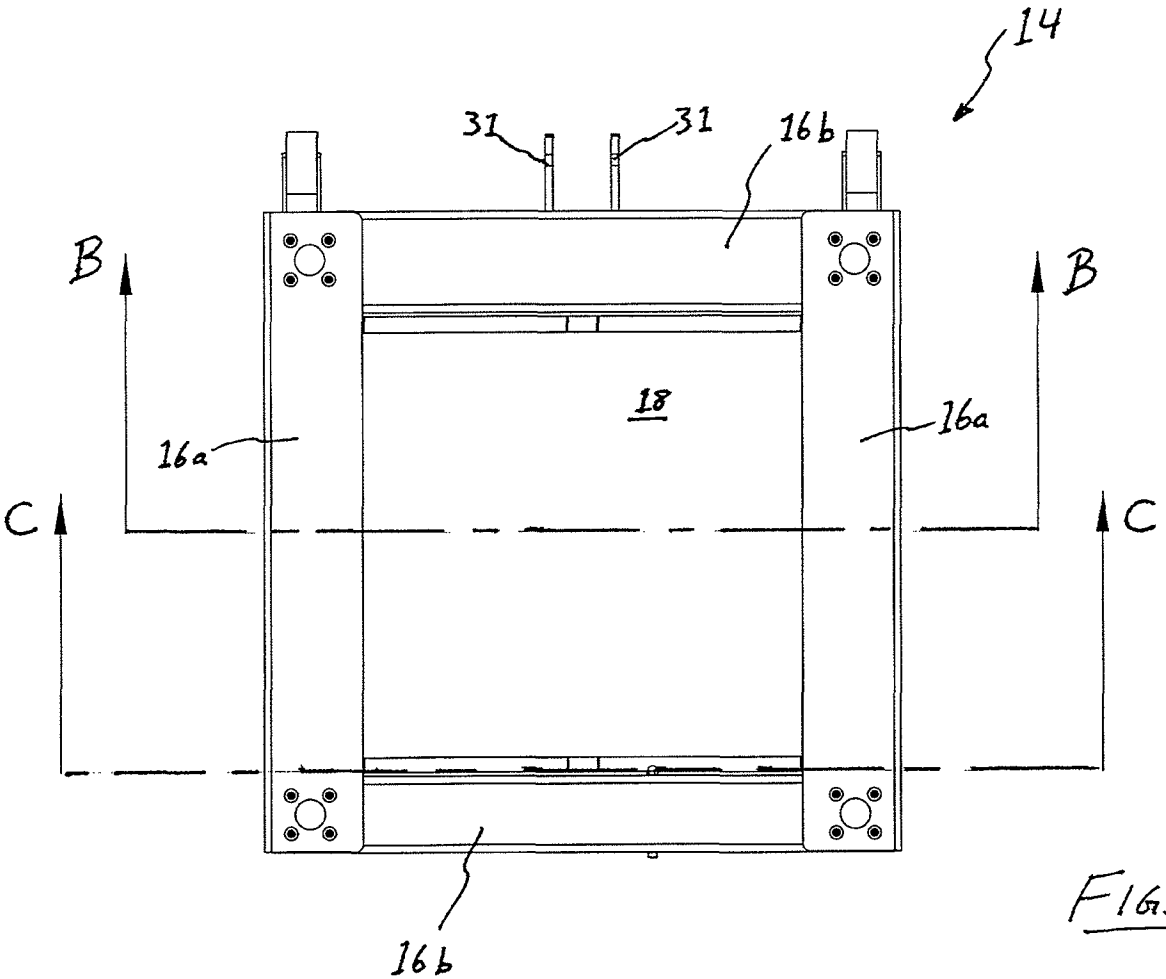
FIG. 6 is a top view of the exemplary adjustable rebound device shown in FIG. 3.
Figure 7:
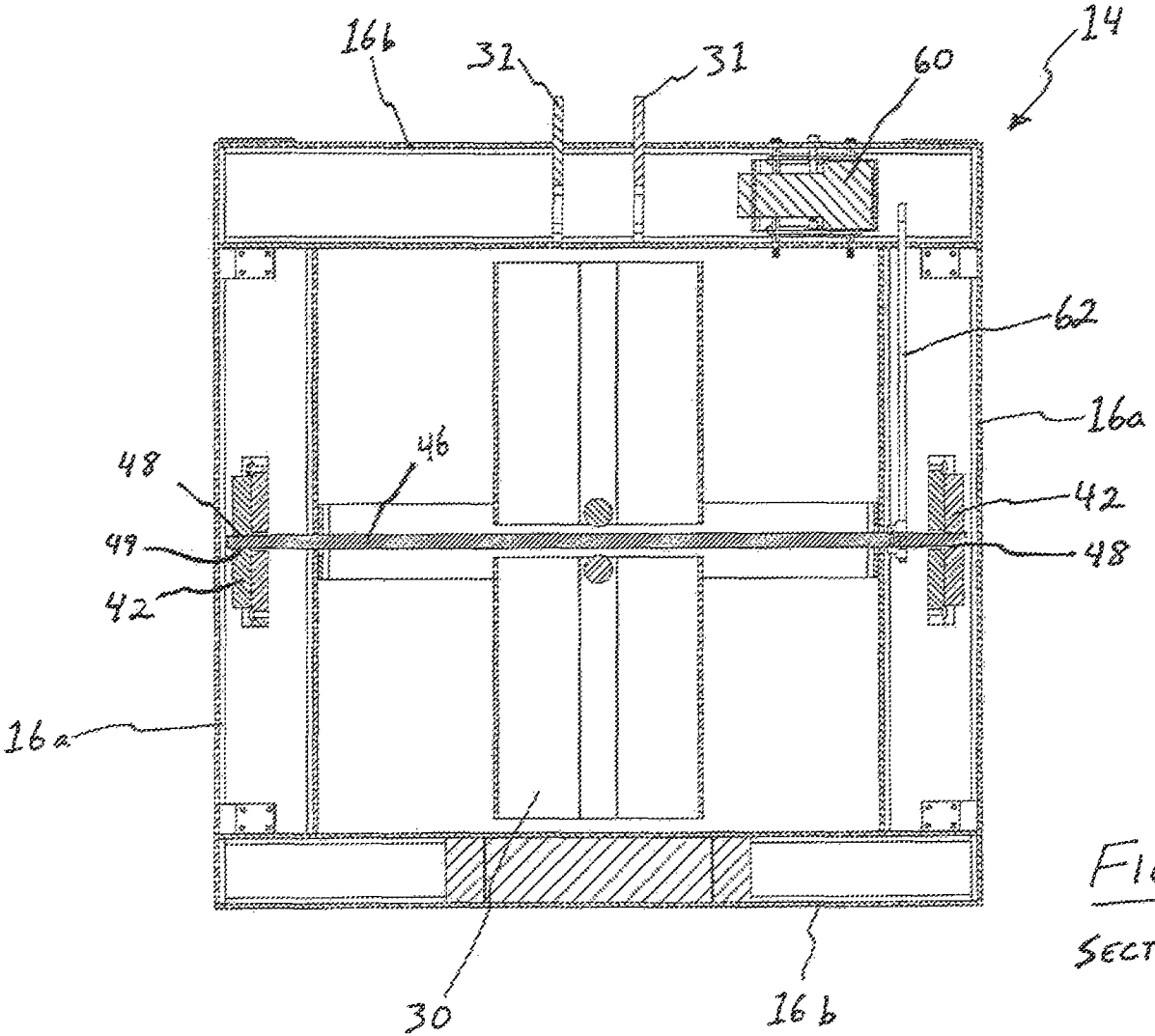
FIG. 7 is a top-section view taken along line A-A of FIG. 5.

FIGS. 5 and 6 show front and top views of an exemplary embodiment of machine base assembly 14. FIG. 7 shows a top section view along line A-A of FIG. 5 of machine base assembly 14 including adjustable rebound platform 12. For the exemplary embodiment illustrated in FIG. 5, shaft 46 spans between frame portions 16*a*. Threaded portions 48 at opposite ends of shaft 46 threadedly engage with corresponding threaded portions of retainers 32. In some embodiments, rotation of shaft 46 may be controlled by a motor 60. For example, motor 60 may be coupled to a drive member 62, which is further coupled to shaft 46 via mechanisms known to those skilled in the art. Motor 60 may be any type of motor, such as a servo motor or stepper motor. In the exemplary embodiment shown in FIG. 7, drive 62 may include any coupling to translate the operation of motor 60 into activation of warping assembly 32. According to some embodiments, drive 62 may include a toothed belt, smooth belt, or chain drive. Alternatives to drive 62 may include a drive shaft having a first gear that mates to a transverse gear on shaft 46. As shaft 46 is rotated, opposing retainers 42 are drawn towards one another, thereby actuating mounting assemblies 34 (see, e.g., FIGS. 4, 10, and 14).

Figure 8:
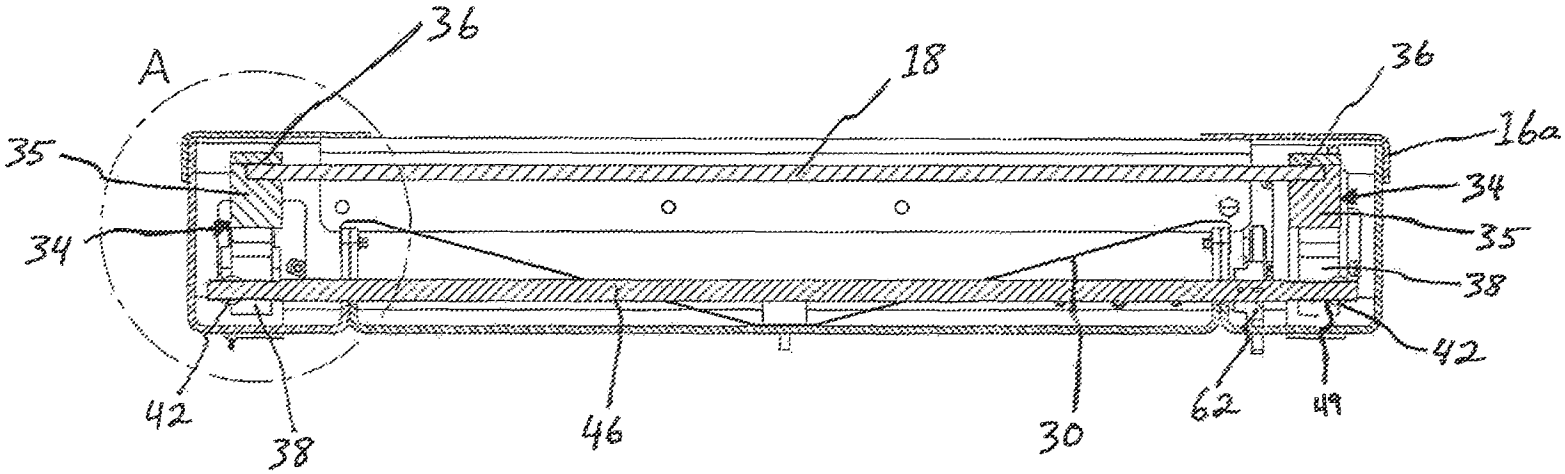
FIG. 8 is a cross-section view taken along line B-B of FIG. 6 of the exemplary adjustable rebound device shown in FIG. 5.
Figure 9:
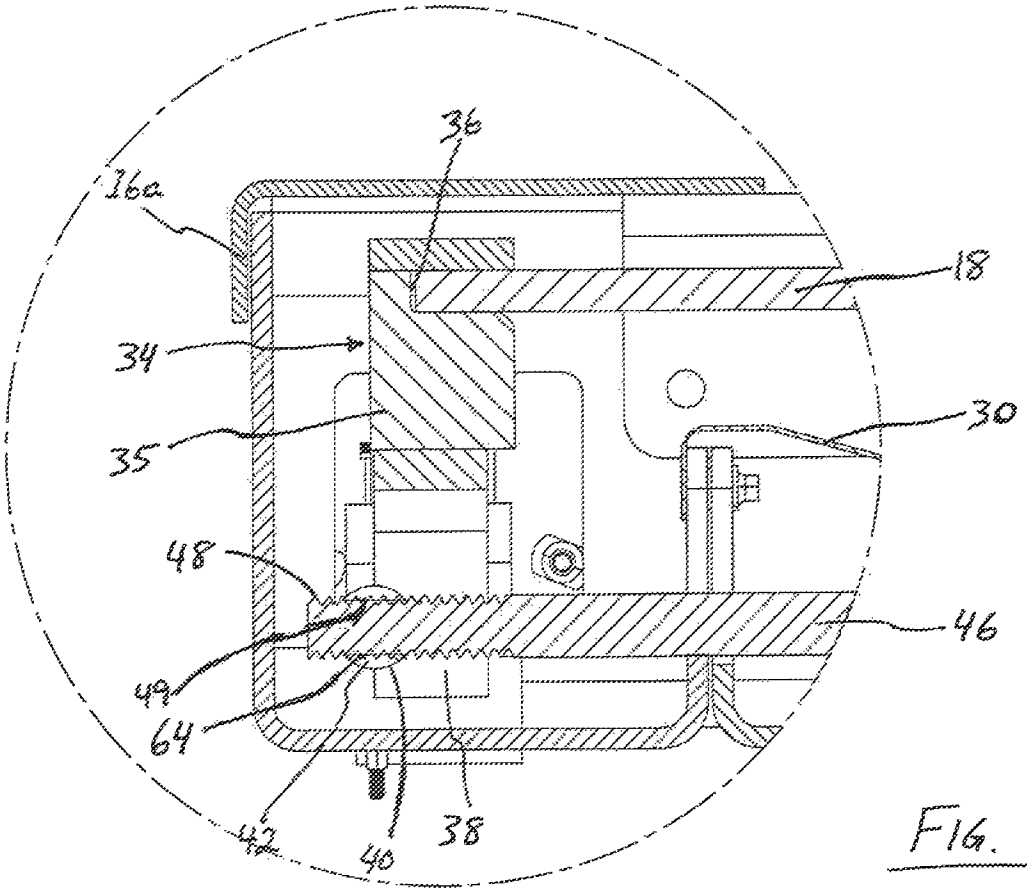
FIG. 9 is a detail view of the cross-section view shown in FIG. 8.

FIG. 8 shows a front section view along line B-B of FIG. 6 of an exemplary embodiment of adjustable rebound platform 12, and one of exemplary mounting assemblies 34 is shown in greater detail in FIG. 9. According to the exemplary embodiments shown in FIGS. 8 and 9, support platform 18 is coupled to mounting assemblies 34 via slots 36 of fixing elements 35. Each of mounting assemblies 34 includes exemplary receiver 38 having a recess 40 into which exemplary retainer 42 is received. Retainer 42 is held in place in recess 40 (see FIG. 9) by shaft 46, which, as described above, is threadedly engaged with retainer 42 by threaded portion 48.

As shown in FIG. 8, exemplary support platform 18 is substantially planar. When substantially planar, support platform 18 provides a surface having greater rebound when deflected, or a lower rebound resistance. For example, when support platform 18 is substantially planar, it has less resistance to flexing when a load is applied to support platform 18, such as by a user jumping on support platform 18. This reduced resistance to flexing aids the user when jumping because support platform 18 behaves more elastically, thereby increasing the ease with which the user can jump. This greater rebound, or lower rebound resistance, may be useful because the lower rebound resistance may require less force for the user to push off from support platform 18, and thus, this lower rebound resistance may allow a user to increase the number of jumps performed before becoming fatigued. A lower rebound resistance may also increase the time duration for which the user can jump before becoming fatigued relative to the support platform having a higher rebound resistance.

Figure 10:
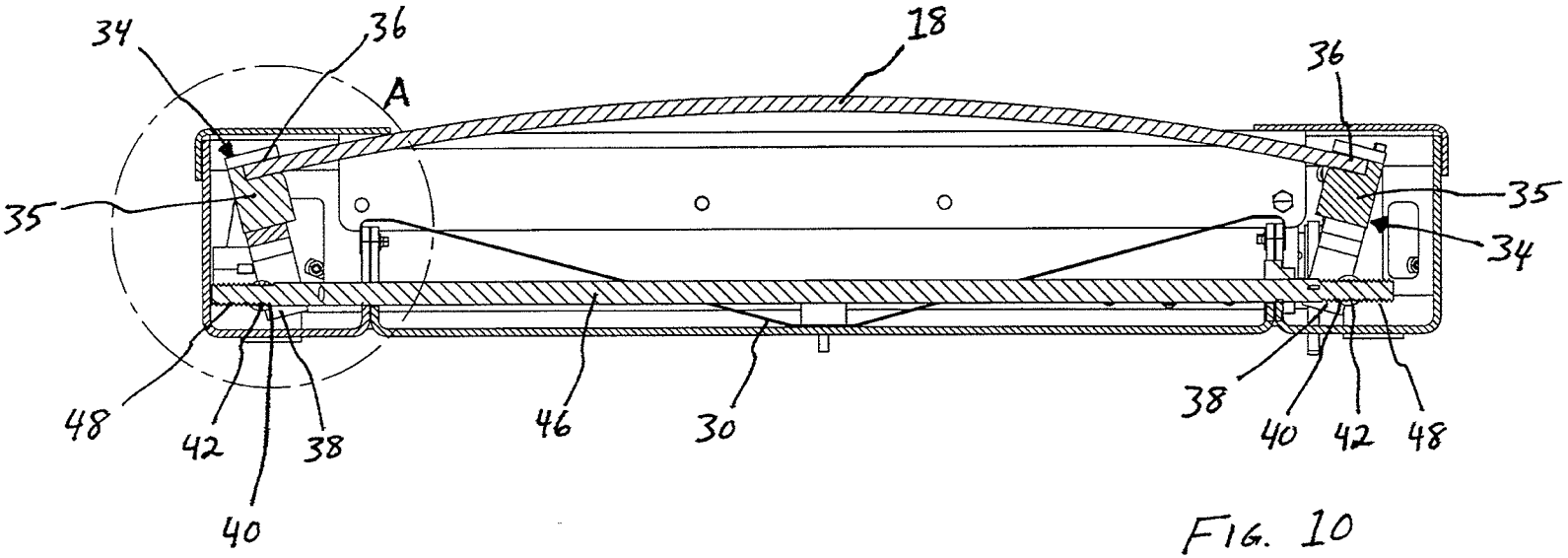
FIG. 10 is the cross-section view shown in FIG. 8 with the exemplary support platform in a warped condition.

FIG. 10 shows the exemplary machine base assembly 14 shown in FIG. 8 after actuation of mounting assemblies 34 by warping assembly 32. Rotation of shaft 46 has caused opposing retainers 42 to be drawn inwardly toward one another, actuating and pivoting fixing elements 35 of mounting assemblies 34 as shown in FIG. 10. A smooth actuation may occur, for example, by receivers 38 pivoting relative to retainers 42 via recesses 40. In some embodiments, retainers 42 may be rod-shaped or cylindrical, and recesses 40 may be a half-round or semi-circular in shape, having substantially the same diameter as exemplary rod-shaped retainers 42. Such an exemplary configuration allows for receivers 38 to smoothly rotate relative to retainers 42.

FIG. 10 also shows exemplary support platform 18 warped through actuation of mounting assemblies 34. As shown in FIG. 10, exemplary warping of support platform 18 results in the center of support platform 18 being projected upwards and outward from machine base assembly 14. For example, when warping assembly 32 includes a shaft 46, as shown in FIG. 10, support platform 18 projects away from shaft 46. When the support platform 18 is warped such that the convex curvature of support platform 18 faces toward the user and away from warping assembly 32, support platform 18 is "crowned," for example, as shown in FIG. 10. Conversely, when support platform 18 is warped such that the convex curvature faces away from the user and toward warping assembly 32, support platform 18 is "dished."

Figure 11:
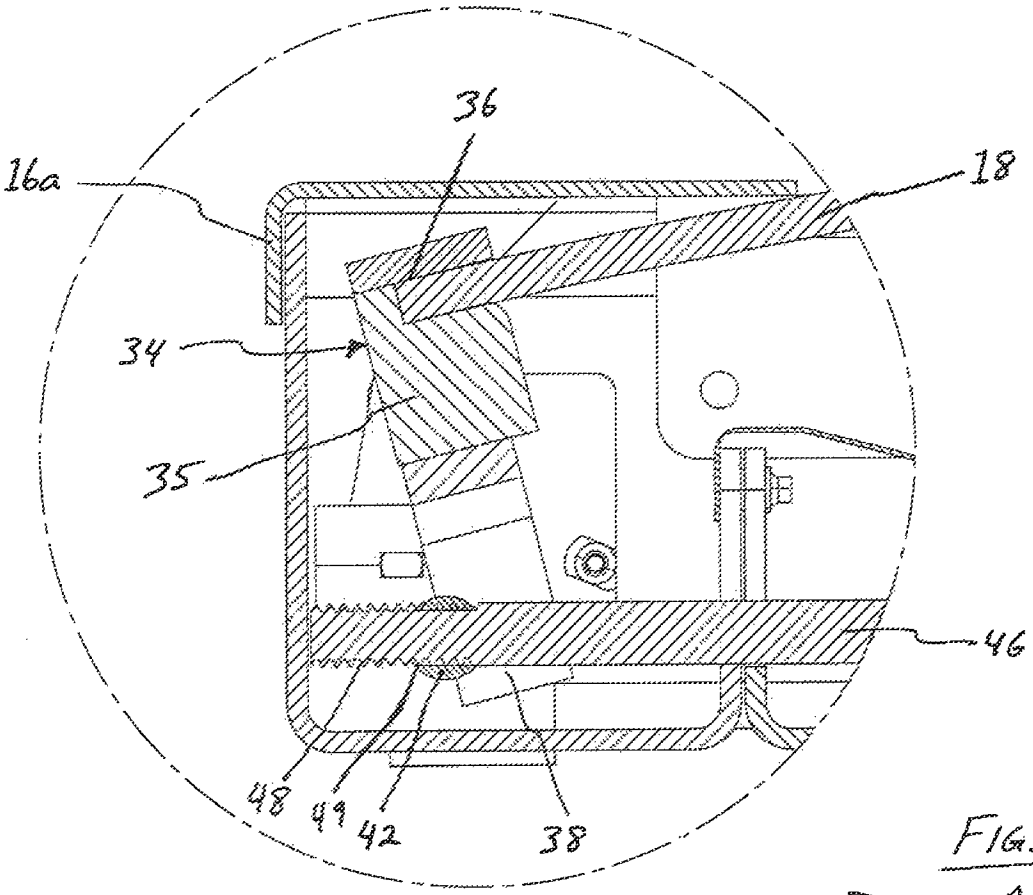
FIG. 11 is the detail view shown in FIG. 9 with the support platform in the warped condition of the cross-section view shown in FIG. 8.

FIG. 11 shows a detail view of FIG. 10, depicting exemplary actuation of one of mounting assemblies 34. When support platform 18 is crowned as shown, the curvature may increase its resistance to compression, such as compression caused during jumping by the user. Increased resistance to compression results in a higher rebound resistance (or a lower rebound), which increases the amount of force required to generate the same height of a jump. In other words, when support platform 18 is crowned it provides less assistance to a user jumping on support platform 18. Because support platform 18 has a higher rebound resistance when crowned, the user may need to exert more energy to maintain a constant jump height or a consistent jump cadence. It may be more difficult to sustain the same jump cadence for a longer period of time. In this way, increasing the rebound resistance, such as by crowning of support platform 18, may allow a user to increase the difficulty of a user's workout session. Conversely, the user may decrease the difficulty of the user's workout by adjusting support platform 18 to a more planar surface. It is contemplated that the relative crowning of support platform 18 may be varied to provide a plurality of rebound resistances.

Figure 12:
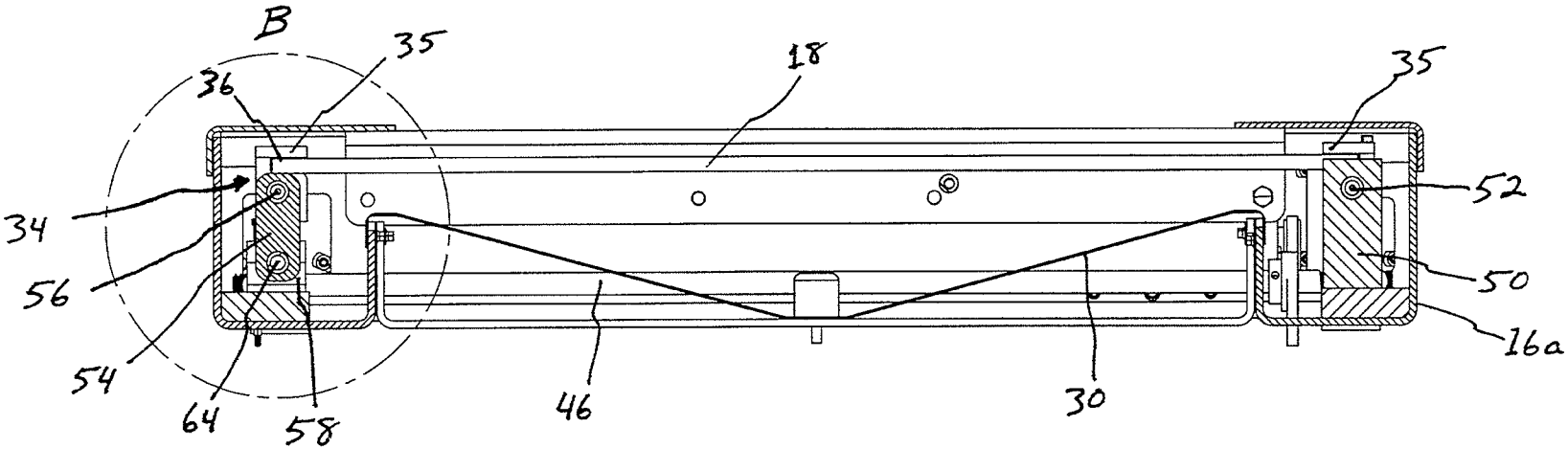
FIG. 12 is a cross-section view taken along line C-C of FIG. 6.

FIG. 12 is a front section view taken along line C-C of FIG. 6. As shown in FIG. 12, machine base assembly 14 includes support platform 18 and an exemplary warping assembly 32. As shown, mounting assemblies 34 are coupled to support platform 18 by slots 36 of fixing members 35. One of mounting assemblies 34 is coupled to mounting blocks 50 by pivot members 52. Actuation of mounting assemblies 34 causes fixing elements 35 to pivot relative to mounting blocks 50 about pivot members 52. Mounting blocks 50 are fixedly attached to frame portion 16*a*. In some embodiments, mounting blocks 50 may slide in a track in frame portion 16*a* during actuation of mounting assembles 34. When mounting blocks 50 are placed in a track, actuation of mounting assemblies 34 allows fixing elements 35 to rotate and may prevent slippage of support platform 18 in slots 36 when support platform 18 is warped.

Figure 13:
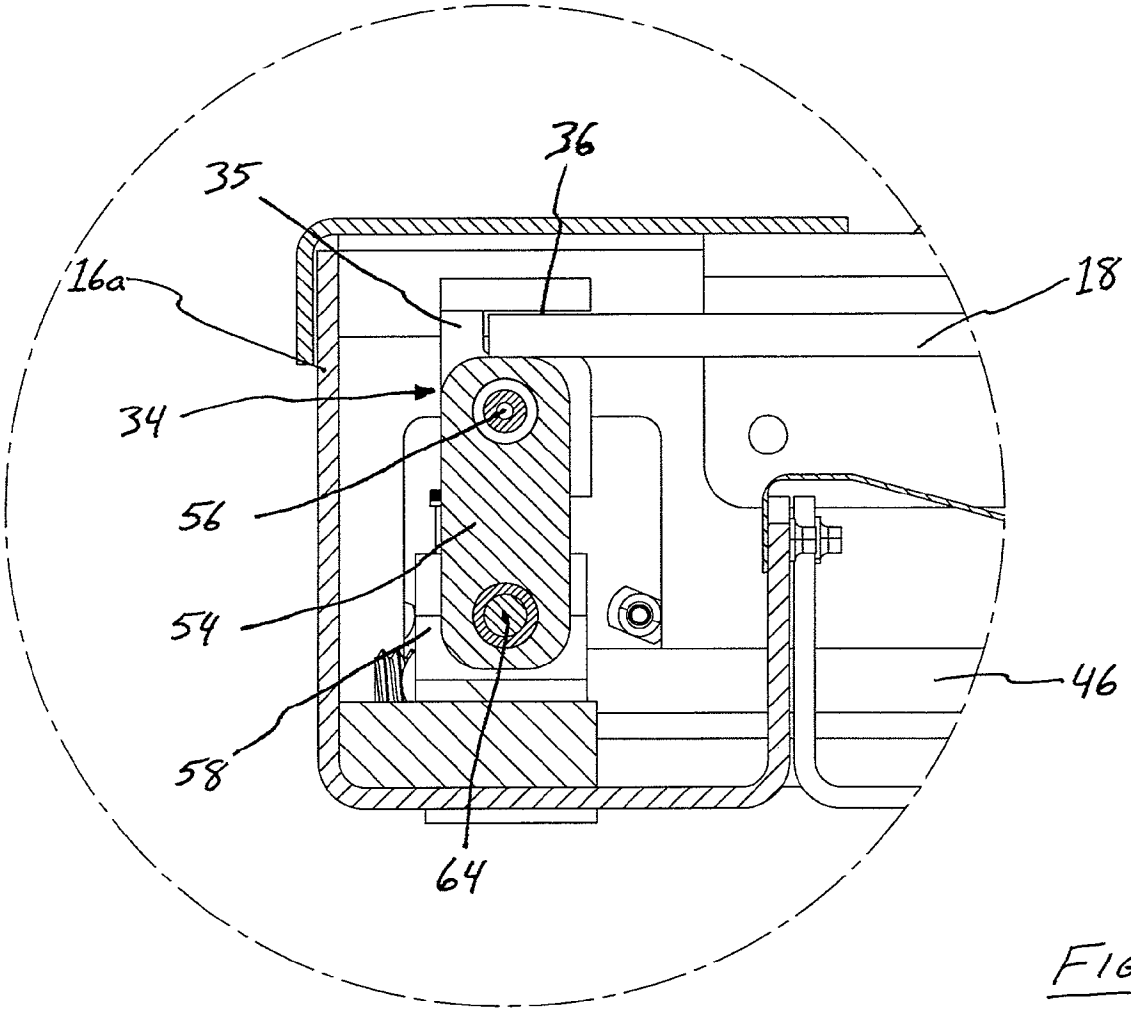
FIG. 13 is a detail view of the cross-section view shown in FIG. 12 of the exemplary adjustable rebound device.

According to the embodiment shown in FIG. 12, one of fixing elements 35 (i.e., the mounting assembly 34 that is opposite the mounting assembly 34 coupled to mounting blocks 50) is coupled to a pair of linkage arms 54 by pivot members 56. Linkage arms 54 are further coupled to basal mounts 58 by pivot members 64. As shown in FIG. 12, support platform 18 is substantially planar, providing a lower rebound resistance (or a greater rebound), as explained previously. FIG. 13 depicts a detail view of a portion of FIG. 12, illustrating one of exemplary fixing elements 35 coupled by exemplary pivot members 56 to exemplary linkage arms 54. Linkage arms 54 are further coupled by exemplary pivot members 64 to exemplary basal mounts 58. Basal mounts 58 may be fixedly attached to frame portion 16*a* or may be movable, such as in a track (not shown).

Figure 14:
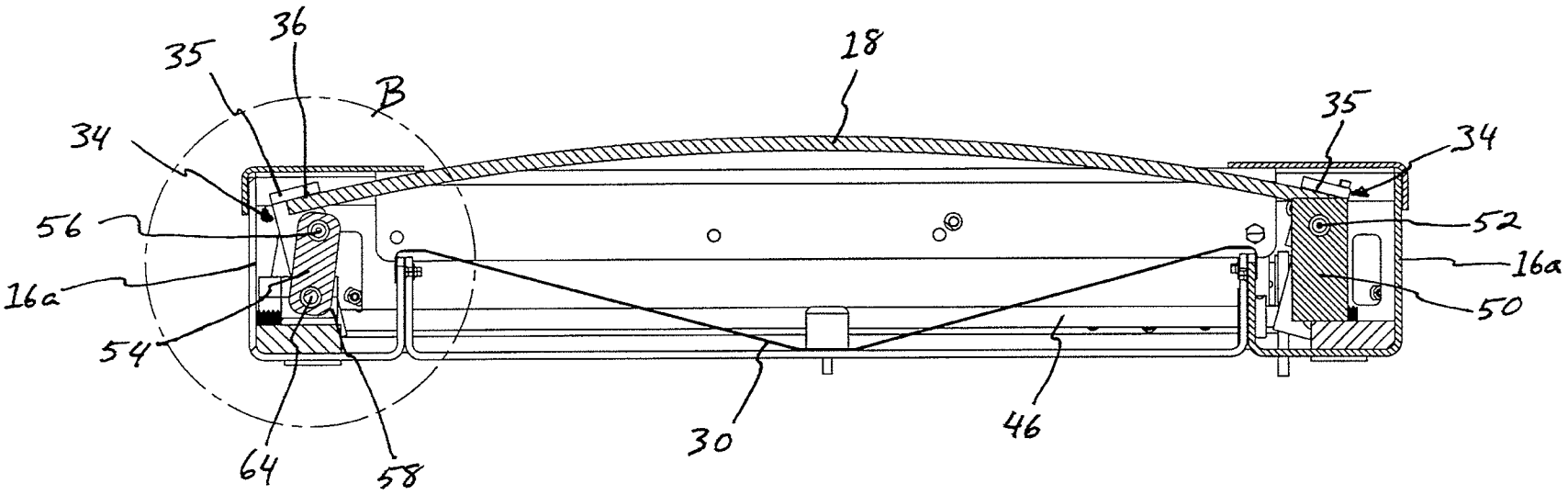
FIG. 14 is the cross-section view shown in FIG. 12 with the support platform in a warped condition.
Figure 15:
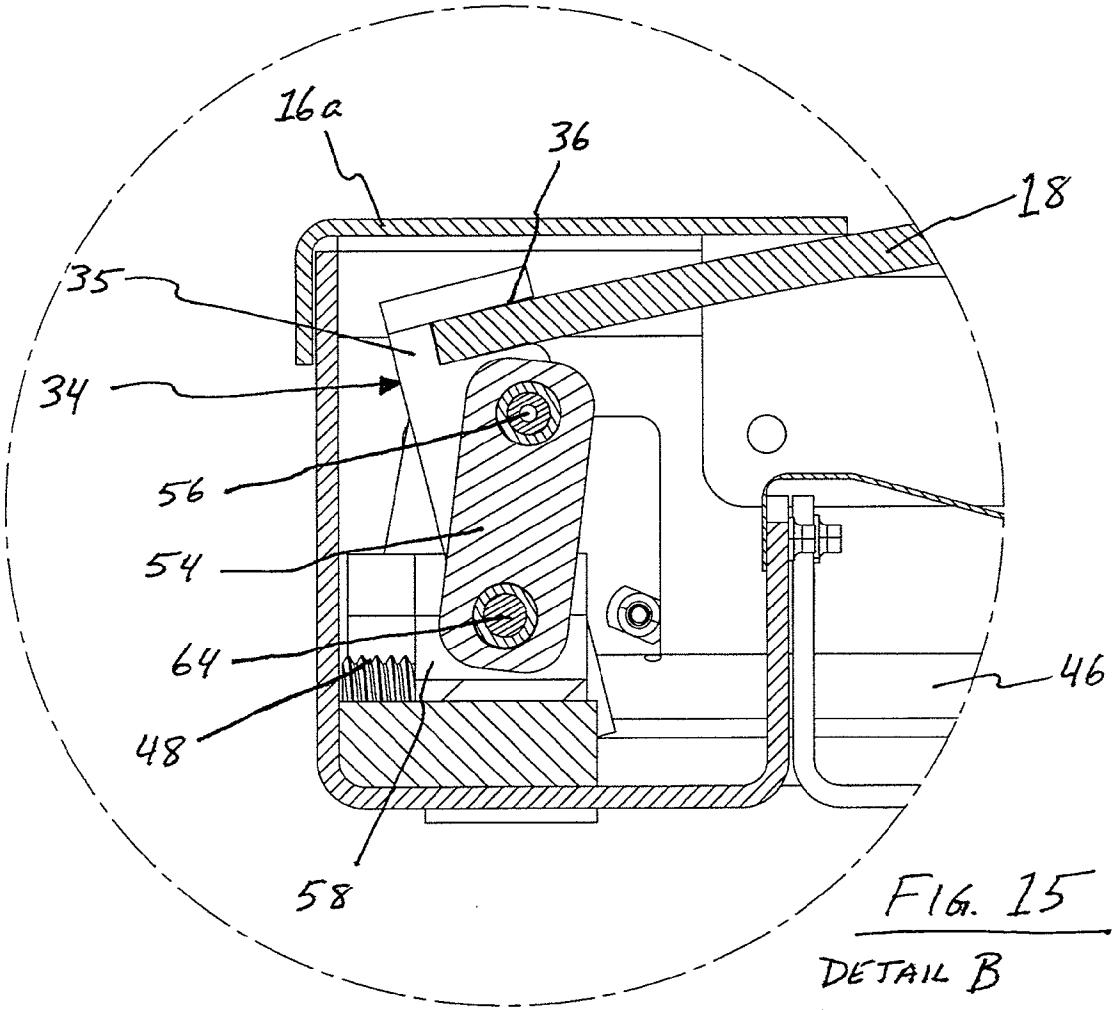
FIG. 15 is a detail view of the cross section shown in FIG. 14.

FIG. 14 depicts an exemplary actuation of mounting assemblies 34. Operation of an exemplary warping assembly 32 depicted in FIGS. 12-14 may include shaft 46 operating in conjunction with receivers 38 and retainers 42 (see, e.g., FIG. 4). Upon actuation, for example, by rotation of shaft 46, linkage arms 54 pivot relative to basal mounts 58 about pivot members 64. Fixing element 35 also pivots about pivot members 56 and relative to linkage arms 54. As shown in FIG. 14, actuation of mounting assemblies 34 according to exemplary operation results in crowning of support platform 18, thereby increasing the rebound resistance of support platform 18 and decreasing the rebound. FIG. 15 shows a detail view of one of mounting assemblies 34 being actuated, as shown in FIG. 14. The pivoting of linkage arms 54 relative to fixing elements 35 and basal mounts 58 can be seen in greater detail in FIG. 15. Although the exemplary embodiments shown in FIGS. 12-15 include linkage arms 54 on only one side of warping assembly 32, it is also contemplated that both sides may contain linkage arms 54 and associated components.

Linkage arms 54 provide a greater range of motion for fixing elements 35 during actuation of mounting assemblies 34. This greater range of motion prevents the edges of support platform 18 from sliding in slots 36 of fixing elements 35 when support platform 18 is crowned. By preventing or reducing slippage, there is a tighter coupling between fixing elements 35 and support platform 18, which may prevent wear or damage to support platform 18 through repeated compression, such as during jumping, increasing the usable life of a given support platform 18.

According to some embodiments, adjustable rebound platform 12 includes machine base assembly 14 and warping assembly 32 to warp exemplary support platform 18. As explained previously, warping of exemplary support platform 18 serves to increase the rebound resistance, thereby decreasing the rebound, such as by crowning support platform 18. Support platform 18 may include an elastically deformable material. Elastically deformable materials include materials that will return to their original shape or configuration after removal of an applied load, such as compression by a user jumping on support platform 18 or stresses applied due to warping of support platform 18 through actuation of mounting assemblies 34. In some embodiments, the elastically deformable material is polycarbonate. Other materials are also contemplated.

It is contemplated that the aspects and embodiments discussed above are merely exemplary and not limiting of an adjustable rebound device or an exercise machine containing an adjustable rebound platform. For example, although warping system 32 is depicted in FIGS. 4-15 as having a rotatable shaft 46 for actuating mounting assemblies 34, it is contemplated that warping assembly 32 may include other mechanisms for actuation, such as a scissor-jack, hydraulic or pneumatic actuators, electrical motors, or servo motors. Other actuation mechanisms are also contemplated. Similarly, FIGS. 4-15 depict shaft 46 as being coupled to two opposing mounting assemblies 34. It is contemplated that the shaft 46, or other warping assembly mechanism, may be coupled to only one of the mounting assemblies 34. FIG. 3 also depicts four frame portions 16*a* and 16*b* as part of exemplary machine base assembly 14; however, some embodiments may include only frame portions 16*a* or 16*b*. The drawings also depict support platform 18 coupled to mounting assemblies 34 positioned within frame portions 16*b*. It is contemplated that support platform 18 may be alternatively coupled to mounting assemblies 34 in other positions relative to frame portions 16*a*.

Figure 18:
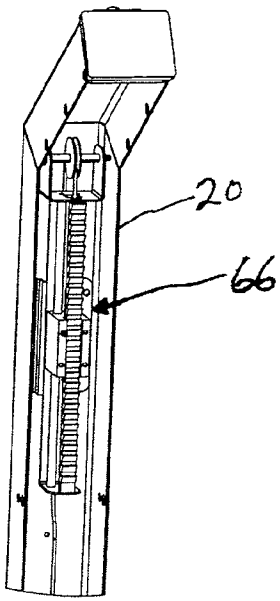
FIG. 18 is the detail view shown in FIG. 17 from an isometric perspective.
Figure 17:
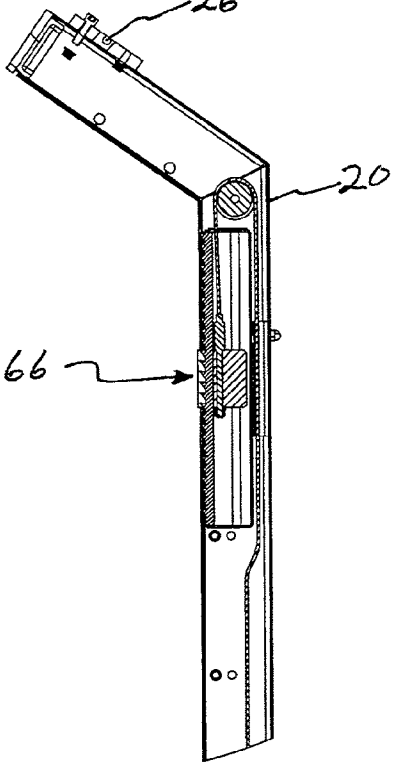
FIG. 17 is a detail view of the cross-section view shown in FIG. 16.
Figure 16:
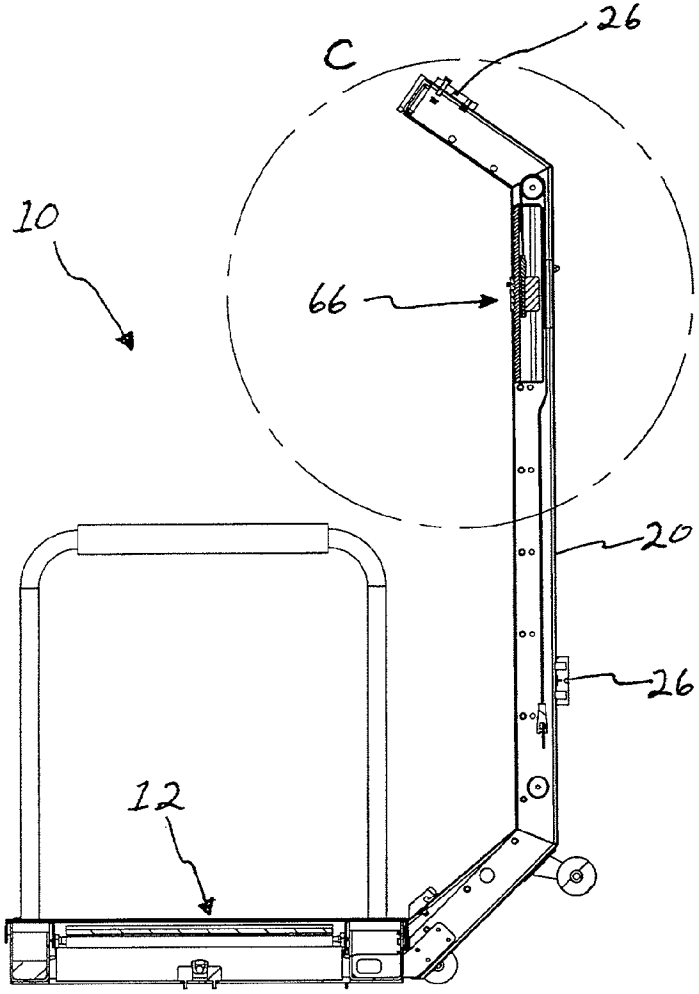
FIG. 16 is a cross-section view of the exemplary exercise machine of FIG. 1.

As explained above, FIG. 1 depicts a column 20 having a visual display unit 22, mounting plates 26 and grips or handles 24. FIG. 16 shows an exemplary side view of exercise machine 10 with an interior view of column 20. FIGS. 17 and 18 depict detailed views of an exemplary interior of column 20. Column 20 may include a visual display unit 22 (see FIGS. 1 and 2) which may be height adjusted according to some embodiments of exercise machine 10. The position of visual display unit 22 relative to column 20 may be adjusted using a height adjustment mechanism 66. According to some embodiments, height adjustment mechanism 66 may include a locking device, such as a ratchet, mounting holes, friction lock, or lockable pulley to change the position of visual display unit 22 on column 20.

As explained above, column 20 may optionally include mounting plates 26 and grips or handles 24. Mounting plates 26 and grips or handles 24 may provide attachment points for resistance devices (not shown), such as elastic resistance bands. By attaching resistance devices to mounting plates 26 or grips or handles 24, a user of exemplary exercise machine 10 may alter a workout routine to include upper body exercises, such as by pulling on the resistance devices.

According to some embodiments, visual display unit 22 may optionally display information related to a user's workout routine. For example, visual display unit 22 may be configured and/or programmed to display a user's heart rate, number of calories burned during a workout, the compression rate of support platform 18 (e.g., the "jump rate"), the relative or absolute rebound resistance of the support platform, cadence or timing errors (e.g., "jump errors"), and/or visual indicators of a user's actual or desired cadence.

According to some embodiments, user interface 21 includes visual display unit 22, which includes a display screen, such as for example, a liquid crystal display (LCD) or light emitting diode (LED) screen. Any display screen may be used, and the type of display unit is not limited by any particular aspect or embodiment. Visual display unit 22 may include a touch-sensitive screen, such as a touch-screen display, for receiving user inputs, or may have an external input source such as a control pad or keyboard. Visual display unit 22 allows a user to input commands, which may be processed by a processor or other computing device contained within exemplary exercise machine 10. For example, a user may input commands such as a preferred rebound resistance or a preferred cadence for a workout. The user may also select a mode choice for a workout session to vary the difficulty of a particular set of exercises. User interface 21 may include a processor to perform calculations or control various functions of visual display unit 22, control unit 23, and/or exercise machine 10. In some embodiments, control unit 23 is contained within visual display unit 22. User interface 21 may also include a memory device for storing software or program-related information. According to some embodiments, the processor and memory are contained in user interface 21, but it is contemplated that either or both of the processor or memory may be stored in a separate device, such as a server, compact disc, or USB token. According to some embodiments, a separate device, such as a USB token, may store information related to a particular user, which may be manually or automatically downloaded to exercise machine 10 as part of a workout session.

According to some embodiments, user interface 21 may include a detachable device, such as a portable tablet computer or portable media player, having a touch-sensitive input screen. Column 20 may, according to some embodiments, provide a dock or connector for connecting the detachable device to exemplary exercise machine 10. The detachable device may contain a program or application compatible with exercise machine 10. One possible advantage of a detachable device, such as a tablet computer or portable media player, is that it may allow a user to record statistics from a workout session and to keep a record of various sessions. In some embodiments, the tablet computer or portable media player may allow a user to save various statistics about their preferred settings for the exercise machine 10, such as the preferred rebound resistance or cadence. Use of a detachable device may also facilitate downloading data associated with a user's workouts to another computer for additional display and/or analysis.

According to some embodiments, user interface 21 may allow a user to select a mode of operation as described in greater detail below. For example, the user may select a desired jumping rate, such as 100 jumps per minute, or a specific time duration for an exercise, such as ten minutes.

According to some embodiments, user interface 21 may display a user's vital statistics such as heart rate, blood pressure, lactic acid level, and/or oxygen uptake rate. These statistics may be retrieved from diagnostic equipment associated with a user. User interface 21 may also include an indication of calories burned during a workout session. For example, the number of calories burned (or the burn rate) may be calculated according to a certain variables, such as, for example, a user's height, weight, heart rate, and/or the compression rate of support platform 18. These variables are not exclusive of the variables that may be used to calculate calories burned, and any acceptable methods may be used.

According to some embodiments, user interface 21 may be configured or programmed to display an indicator of the relative warping of support platform 18. According to some embodiments, an indicator of the warping may correlate to the amount of strain applied to the support platform 18 by warping assembly 32, or may be an indication that the user has compressed the support platform, such as by jumping. The indicator may be output in units of force, or may be a relative amount, such as 0 to 100 percent of the maximum warping the support platform by activation of mounting assemblies 34. For example, a substantially planar support platform 18 may result in display of an indicator of 0 percent compression or warping, while a fully-crowned support platform 18 may display of an indicator of 100 percent compression or warping. According to some embodiments, the indication of compression may use the change in strain when a user jumps to calculate the amount of force applied by the user during a jump. It should be understood that 100 percent compression or warping does not necessarily mean that support platform 18 cannot be compressed or warped further, but rather that support platform 18 has reached 100 percent of the warping provided by actuation of mounting assemblies 34.

The strain (e.g., compression) of support platform 18 may be measured, for example, by a sensor 70, such as, for example, a strain measuring device, mounted on exercise machine 10. In some embodiments, the strain measuring device is positioned on one or more of mounting assemblies 34 (e.g., on one or more of fixing elements 35). In other embodiments, the strain measuring device may be positioned directly on support platform 18 or any other appropriate portion of exercise machine 10. In some embodiments, the sensor may be a strain gauge that measures a change in strain on support platform 18 on one or more of mounting assemblies 34. According to some embodiments, the sensor may be a load cell that sends an electrical signal to a processor. In particular, a load cell or strain gauge may be particularly useful for measuring when a user acts to compress support platform 18, such as by jumping or landing on support platform 18. Other types of sensors are also contemplated, including, for example, optical or acoustic sensors. Sensor 70 may include or be coupled to a processor or other device for determining or outputting signals based on sensor 70. The compression may also be calculated or measured indirectly according to the actuation of mounting assemblies 34 by warping assembly 32. For example, as warping assembly 32 is operated, the amount of crowning of support platform 18 can be determined, and the compression of support platform 18 may be estimated or determined via look-up tables or equations.

For example, when exemplary shaft 46 rotates a known amount, retainers 42 will be drawn by a known distance toward one another, resulting in a known or calculable actuation of mounting assemblies 34. The known or calculable actuation of mounting assemblies 34 will impart a known or calculable amount of warping to support platform 18, and the amount of strain needed to impart the known or calculable warping may be determined by, for example, a processor via look-up tables or equations.

According to some embodiments, control unit 23 may also be used to calculate a compression cycle or "jump rate" during a particular period of time. For example, sensor 70 (e.g., a strain gauge or load cell) may detect each time a user jumps on support platform 18, with each registered compression being associated with a timer. From this information, a processor may determine an actual compression cycle, such as when each jump occurs and the timing between jumps, or a compression rate, such as by dividing the number of jumps by a predetermined time, for example, the number of jumps per minute. User interface 21 may display information related to the compression cycles, such as, the compression rate in jumps per minute or other graphical representation.

According to some embodiments, a control unit 23 may include memory or processor for storing a predetermined compression cycle or compression rate. Based on the information from the strain measuring device, the processor may compare the measured compression cycle to the predetermined cycle. If the measured cycle deviates from the predetermined cycle, then the processor may output a fault signal. According to some embodiments, the comparison may compare the calculated rate in jumps per minute with a predetermined rate, and if the calculated rate is less than the predetermined rate, then the processor may output a fault signal. According to some embodiments, if the calculated rate deviates from the predetermined rate by more than a predetermined amount, for example, by more than ten percent or more than five jumps per minute, higher or lower than the predetermined rate, then the processor may output a fault signal. According to some embodiments, the processor may compare the timing of each jump with a predetermined expected jump timing, and if any individual jump deviates from the expected jump timing by more than a predetermined amount, for example, by one-half second, then the processor may output a fault signal. According to some embodiments, the processor may compare the jump cycle of a plurality of jumps, and if a specified number of jumps, for example, more than two, deviates from the predetermined cycle, then the processor may output a fault signal. According to some embodiments, the compression cycle may be compared with the timing of a jump cue provided to the user (e.g., a visual and/or aural cue), described below, and if the timing of a compression deviates from the timing of the cue by more than a predetermined amount, for example, by more than one-half second before or after the cue, then the processor may output a fault signal.

According to some embodiments, user interface 21 may be configured to provide a jump cue. For example, the jump cue may be an aural cue such as the word "jump" or a beeping or chirping sound. The jump cue may also be (either instead of or in addition to the aural cue) a visual cue on user interface 21, such as an illuminated light, icon, or other visual signal. One example of a visual cue may be a line or sequence of lights passing vertically from the top of the visual display to the bottom of the visual display. The line may pass through a "jump region" indicating when the user should jump. An example of a jump region on user interface 21 may include one or more arrows or a colored block defining the region. When the line passes through a particular region, such as a "jump region" of user interface 21, the processor may determine whether the user has jumped by using the signal from sensor 70. A visual cue, such as the linear movement of a line across the user interface, may appear as a simulation of a jump rope passing across or down user interface 21. Other visual cues are also contemplated. According to some embodiments, the timing of the aural cue or visual cue may be set by the user based on the rhythm of music played through a device, such as, for example, control unit 23 or an external tablet computer or music player.

Figure 19:
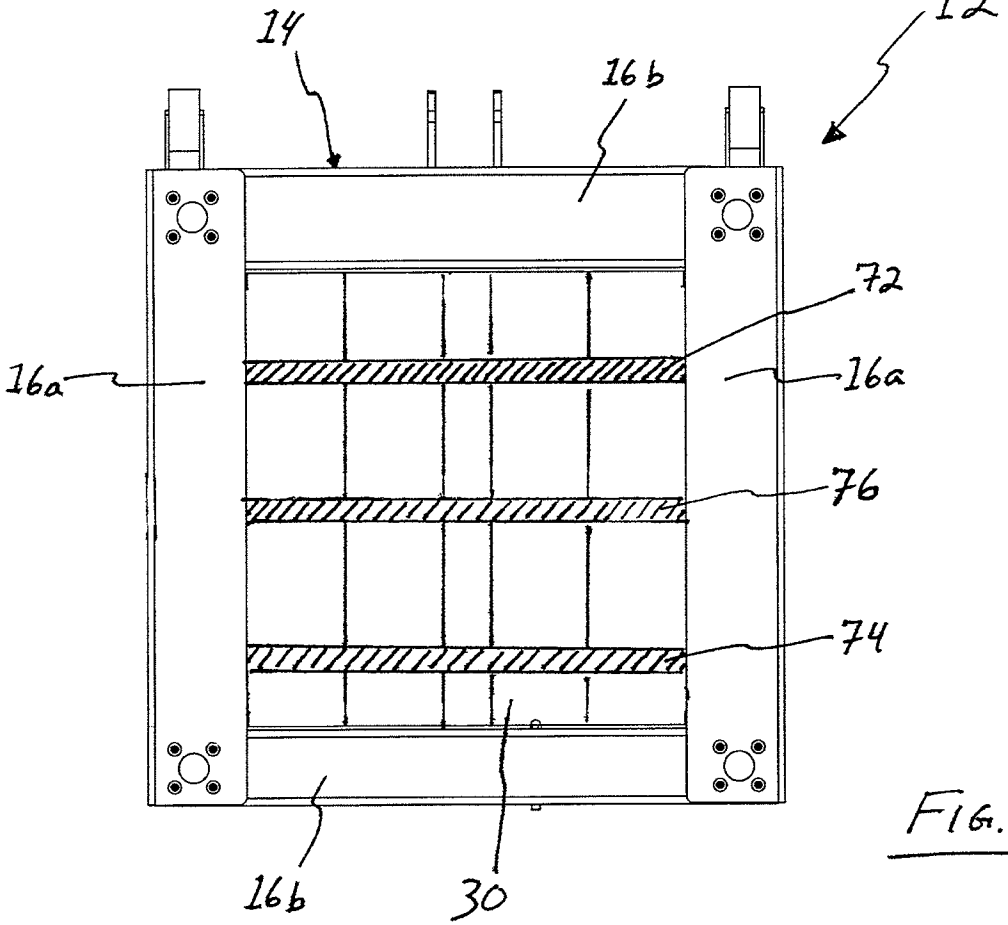
FIG. 19 is the top view of FIG. 6 with the support platform removed.

Exercise machine 10, according to some embodiments, may also include a series of light sources associated with (e.g., within) adjustable rebound platform 12. FIG. 19 shows, for example, the top view of FIG. 6 with support platform 18 removed to show a plurality of light sources 72, 74, and 76. The light sources may include a series of light bars, such as, for example, strings of light emitting diodes ("LEDs"), placed beneath support platform 18. According to some embodiments, support platform 18 may be transparent or translucent and, a reflector, for example, reflector 30 shown in FIGS. 2 and 19, may reflect light from the light sources upward toward the user through support platform 18. Exemplary light sources may be arranged in linear rows. For example, a first light source 72 may span between frame portions 16*a* near the front of the exercise machine, for example, near frame portion 16*b* adjacent column 20 as shown in FIG. 1. Each end of first light source 72 may be attached to each of frame portions 16*a*. A second light source 74 may span between frame portions 16*a* near the rear of exercise machine 10, for example, near frame portion 16*b* opposite column 20 in FIG. 1. One or more additional light sources 76 may also span between frame portions 16*a* between first light source 72 and second light source 74. According to some embodiments, the light sources may be illuminated in sequence from first light source 72 to second light source 74. When viewed from above, this may simulate the visual effect of a jump rope passing underneath the user, providing a visual cue for the user to "jump over" the light passing beneath the user.

According to some embodiments, a single light source or band may be illuminated, such that it passes from the front to the back of support platform 18, for example, by a pulley or rotating belt. In some embodiments, a continuous belt containing a plurality of light sources or bands may be rotated beneath support platform 18, creating the illusion of a passing rope. According to some embodiments, a single light band may extend from adjacent to column 20 to the rear of support platform 18, and the lights of the light band may be sequentially illuminated from the front to rear of support platform 18.

According to some embodiments, the plurality of light sources need not be aligned from front to back, but may instead (or in addition) be aligned from side to side. For example, each light source spans between frame portions 16*b* in FIGS. 1 and 19 (e.g., perpendicular to light sources 72, 74, and 76 of FIG. 19). For example, in such embodiments, illuminating the plurality of light sources from left-to-right, then right-to-left, a user may perform an exercise requiring the user to jump from side-to-side rather than merely up and down. According to some embodiments, the light sources may be illuminated from front-to-back, then back-to-front, requiring a user to jump forward then backwards. Sensors, such as strain measuring devices, coupled to a processor may compare the compression of support platform 18 with the position of an illuminated light source at a predetermined time, and if the user is not jumping at an expected time or position, then the processor may output a fault signal as described above.

According some embodiments, exercise machine 10 may be configured to operate according to multiple modes selected by a user. For example, in an exemplary, "standard" mode, the user may set a minimum jumping rate. If the user jumps at a jumping rate exceeding the minimum rate, as measured by a strain measuring device, a processor may count the number of jumps performed by the user and output an indicator of the jumps on the screen, such as a counter displaying the number of jumps performed or the user's jump rate. If the user's actual jump rate does not exceed the minimum jumping rate, the exercise machine may provide a visual or aural indicator to the user, signifying that the user must jump faster (i.e., at a higher rate).

In some embodiments, exercise machine 10 may also include an "advanced" mode in which the user may set a desired jumping rate or cycle. If the user's actual jumping rate or cycle does not deviate (either more or less) from the desired rate or cycle by more than a specific amount, for example, by more than five jumps per minute or by more than ten percent of the desired rate, then visual display unit 22 may display the number of "good jumps" by the user (e.g., those within the acceptable deviation from the desired rate or cycle). According to some embodiments, the allowable deviation may be fixed. In some embodiments, a user may vary the allowable deviation, or the user may be able to select or set an allowable deviation from the desired cycle or rate.

According to some embodiments, control unit 23 may be configured or programmed to permit a user to select from a plurality of preset exercise routines of varying difficulty. For example, an "easy" routine may include a lower jump rate, for example, 30 jumps per minute, or a shorter time duration, for example, one minute. As another example, an "advanced" routine may include increased difficulty, such as a higher jump rate, for example 100 jumps per minute, or a longer duration, for example, ten minutes. Exemplary preset routines may include varying degrees of difficulty, such as having "warm-up" or "cool-down" periods of easier difficulty and advanced periods of increased difficulty. In some embodiments, the user may manually select or create a particular program or difficulty via visual display unit 22.

In some embodiments, the fault signal may be used to provide an aural indicator to the user, such as a buzzer or beeping sound. In some embodiments, the fault signal may be used to output a visual indicator on visual display unit 22. The visual indicator of the fault may appear in many forms, for example, an "X" may appear on user interface 21, a counter on user interface 21 may increase by counting the number of faults, or a red light may be illuminated on user interface 21.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An adjustable rebound device comprising:

a support platform; and a warping assembly configured to adjust a rebound resistance of the support platform, the warping assembly comprising:

a plurality of mounting assemblies coupled to the support platform, and a rebound adjustment assembly coupled to at least one of the mounting assemblies, wherein the rebound adjustment assembly is configured to actuate the at least one mounting assembly such that the support platform is warped and the rebound resistance of the support platform is adjusted, and wherein the rebound adjustment assembly comprises a shaft coupled to the at least one mounting assembly such that movement of the shaft causes warping of the support platform.

2. The device of claim 1, wherein the at least one mounting assembly further comprises a receiver coupled to the support platform, and a retainer coupled to the shaft and the receiver, such that movement of the shaft results in movement of the receiver, thereby causing warping of the support platform.

3. The device of claim 2, wherein the shaft comprises a threaded portion, and the retainer comprises a threaded portion threadedly engaged with the threaded portion of the shaft, such that rotation of the shaft causes movement of the receiver.

4. The device of claim 3, wherein the retainer comprises a rod portion, and the receiver comprises a recess receiving the rod portion, such that the rod portion is configured to rotate relative to the recess upon rotation of the shaft.

5. The device of claim 1, wherein the support platform comprises an elastically deformable material.

6. The device of claim 5, wherein the elastically deformable material comprises polycarbonate.

7. The device of claim 1, wherein warping of the support platform comprises crowning the support platform.

8. The device of claim 7, wherein the crowning of the support platform increases the rebound resistance of the support platform.

9. The device of claim 1, further comprising a motor coupled to the warping assembly, wherein operation of the motor is configured to cause actuation of the at least one mounting assembly by the rebound adjustment assembly, such that the support platform is warped.

10. The device of claim 1, wherein the warping assembly further comprises at least one basal mount and a linkage arm pivotally coupled to the at least one basal mount and the at least one mounting assembly, wherein upon actuation of the at least one mounting assembly by the rebound adjustment assembly, the linkage arm pivots relative to the at least one basal mount and the at least one mounting assembly, such that the support platform is warped.

11. A method of adjusting rebound resistance of a support platform, the method comprising:

coupling the support platform to a warping assembly, wherein the warping assembly is configured to adjust the rebound resistance of the support platform, the warping assembly comprising a plurality of mounting assemblies coupled to the support platform, and a rebound adjustment assembly coupled to at least one of the mounting assemblies; and actuating the at least one mounting assembly via the rebound adjustment assembly thereby warping the support platform, such that the rebound resistance of the support platform is adjusted, wherein actuating the at least one mounting assembly comprises moving a shaft coupled to the at least one mounting assembly, such that movement of the shaft causes warping of the support platform.

12. The method of claim 11, wherein the at least one mounting assembly comprises a receiver coupled to the support platform and a retainer coupled to the shaft, and wherein moving the shaft results in movement of the receiver, thereby warping the support platform.

13. The method of claim 12, wherein moving the shaft comprises rotating the shaft such that a threaded portion of the shaft engages with a threaded portion of the retainer thereby causing the movement of the receiver.

14. The method of claim 13, wherein rotating the shaft results in rotation of a rod portion of the retainer relative to a recess portion of the receiver in which the rod portion is received.

15. The method of claim 11, wherein warping the support platform comprises crowning the support platform.

16. The method of claim 15, wherein the crowning the support platform increases the rebound resistance of the support platform.

17. The method of claim 11, wherein actuating the at least one mounting assembly comprises operating a motor coupled to the warping assembly.

18. The method of claim 11, wherein actuating the at least one mounting assembly comprises rotating a linkage arm pivotally coupled to at least one basal mount and the at least one mounting assembly.

19. An exercise machine comprising:

a machine base assembly comprising a first frame portion and a second frame portion;

a support platform associated with the first frame portion and the second frame portion; and a warping assembly configured to adjust a rebound resistance of the support platform, the warping assembly comprising:

a plurality of mounting assemblies coupled to the support platform, and a rebound adjustment assembly coupled to at least one of the mounting assemblies, wherein the rebound adjustment assembly is configured to actuate the at least one mounting assembly such that the support platform is warped and the rebound resistance of the support platform is adjusted, and wherein the rebound adjustment assembly comprises a shaft coupled to the at least one mounting assembly such that movement of the shaft causes warping of the support platform.

20. The machine of claim 19 wherein the at least one mounting assembly further comprises a receiver coupled to the support platform, and a retainer coupled to the shaft and the receiver, such that movement of the shaft results in movement of the receiver, thereby causing warping of the support platform.

21. The machine of claim 20, wherein the shaft comprises a threaded portion, and the retainer comprises a threaded portion threadedly engaged with the threaded portion of the shaft, such that rotation of the shaft causes movement of the receiver.

22. The machine of claim 21, wherein the retainer comprises a rod portion, and the receiver comprises a recess receiving the rod portion, such that the rod portion is configured to rotate relative to the recess upon rotation of the shaft.

23. The machine of claim 19, wherein the support platform comprises an elastically deformable material.

24. The machine of claim 23, wherein the elastically deformable material comprises polycarbonate.

25. The machine of claim 19, wherein warping of the support platform comprises crowning the support platform.

26. The machine of claim 25, wherein the crowning of the support platform increases the rebound resistance of the support platform.

27. The machine of claim 20, further comprising:

a user interface coupled to the machine, the user interface being configured to facilitate control of the machine and feedback to the user.

28. The machine of claim 27, wherein the user interface comprises a control unit, wherein the control unit is configured to facilitate actuation of the warping assembly.

29. The machine of claim 28, wherein the control unit is configured to provide the user with an aural or visual cue for jumping.

30. The machine of claim 29, further comprising:

a first light source associated with the machine base assembly;

a second light source associated with the machine base assembly;

a third light source associated with the machine base assembly; and a controller for controlling the illumination of the first light source, the second light source, and the third light source, such that the first light source, the second light source, and the third light source provide a visual cue for jumping.

31. The machine of claim 30, wherein the first, second, and third light sources are aligned with one another, and the controller is configured to sequentially illuminate the first, second, and third light sources.

32. The machine of claim 28, further comprising a sensor configured to provide signals indicative of mechanical strain associated with the support platform.

33. The machine of claim 32, wherein the sensor is coupled to the control unit, and the control unit is configured to determine a compression cycle rate associated with the support platform, based on the signals from the sensor.

34. The machine of claim 33, wherein the user interface further comprises a display unit, and the control unit is configured to output an indication of the compression cycle rate on the display unit.

35. The machine of claim 33, wherein the control unit is configured to compare the compression cycle rate with a predetermined rate, and if the compression cycle rate differs from the predetermined rate by more than a predetermined amount, output a fault signal.

36. The machine of claim 35, wherein the control unit is configured to output at least one of a visual indicator on the display unit or an aural indicator, based on the fault signal.

37. The machine of claim 33, wherein the control unit is configured to compare a timing period of the number of compression cycles with a timer and, if the timing period of the number of compression cycles differs from the timer by more than a predetermined amount, output a fault signal.

38. The machine of claim 37, wherein the control unit is configured to output at least one of a visual indicator on the display unit or an aural indicator, based on the fault signal.

39. The machine of claim 19, further comprising a motor coupled to the warping assembly, wherein operation of the motor is configured to cause actuation of the at least one mounting assembly such that the support platform is warped.

40. The machine of claim 19, wherein the warping assembly further comprises at least one basal mount and a linkage arm pivotally coupled to the at least one basal mount and the at least one mounting assembly, wherein upon actuation of the at least one mounting assembly by the rebound adjustment assembly, the linkage arm pivots relative to the at least one basal mount and the at least one mounting assembly, such that the support platform is warped.

* * * * *